US006753751B2

(12) United States Patent
Fujiwara et al.

(10) Patent No.: US 6,753,751 B2
(45) Date of Patent: Jun. 22, 2004

(54) MAGNETIC CORE INCLUDING MAGNET FOR MAGNETIC BIAS AND INDUCTOR COMPONENT USING THE SAME

(75) Inventors: Teruhiko Fujiwara, Sendai (JP); Masayoshi Ishii, Sendai (JP); Haruki Hoshi, Sendai (JP); Keita Isogai, Sendai (JP); Toru Ito, Miyagi (JP); Tamiko Ambo, Tokyo (JP)

(73) Assignee: NEC Tokin Corporation, Sendai (JP)

( * ) Notice: Subject to any disclaimer, the term of this patent is extended or adjusted under 35 U.S.C. 154(b) by 21 days.

(21) Appl. No.: 09/997,066

(22) Filed: Nov. 29, 2001

(65) Prior Publication Data

US 2002/0097126 A1 Jul. 25, 2002

(30) Foreign Application Priority Data

Nov. 30, 2000 (JP) ..... 2000/364074
Nov. 30, 2000 (JP) ..... 2000/364132
Apr. 17, 2001 (JP) ..... 2001/117665

(51) Int. Cl.[7] ..... H01F 21/00
(52) U.S. Cl. ..... 336/110; 336/233; 335/302
(58) Field of Search ..... 336/110, 233, 336/234; 335/302–306; 148/101–108; 428/694 BA, 928

(56) References Cited

FOREIGN PATENT DOCUMENTS

JP 50-133453 10/1975

*Primary Examiner*—Tuyen T. Nguyen
(74) *Attorney, Agent, or Firm*—Frishauf, Holtz, Goodman & Chick, P.C.

(57) ABSTRACT

An inductor component according to the present invention includes a magnetic core including at least one magnetic gap having a gap length of about 50 to 10,000 $\mu$m in a magnetic path, a magnet for magnetic bias arranged in the neighborhood of the magnetic gap in order to supply magnetic bias from both sides of the magnetic gap, and a coil having at least one turn applied to the magnetic core. The aforementioned magnet for magnetic bias is a bonded magnet containing a resin and a magnet powder dispersed in the resin and having a resistivity of 1 Ω·cm or more. The magnet powder includes a rare-earth magnet powder having an intrinsic coercive force of 5 KOe or more, a Curie point of 300° C. or more, the maximum particle diameter of 150 $\mu$m or less, and an average particle diameter of 2.0 to 50 $\mu$m and coated with inorganic glass, and the rare-earth magnet powder is selected from the group consisting of a Sm—Co magnet powder, Nd—Fe—B magnet powder, and Sm—Fe—N magnet powder.

34 Claims, 22 Drawing Sheets

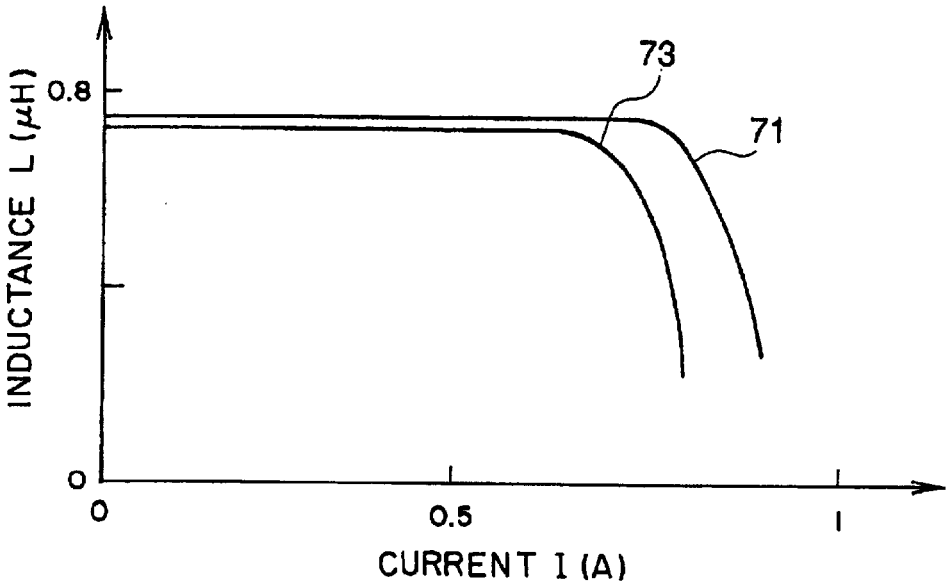
FIG. 17
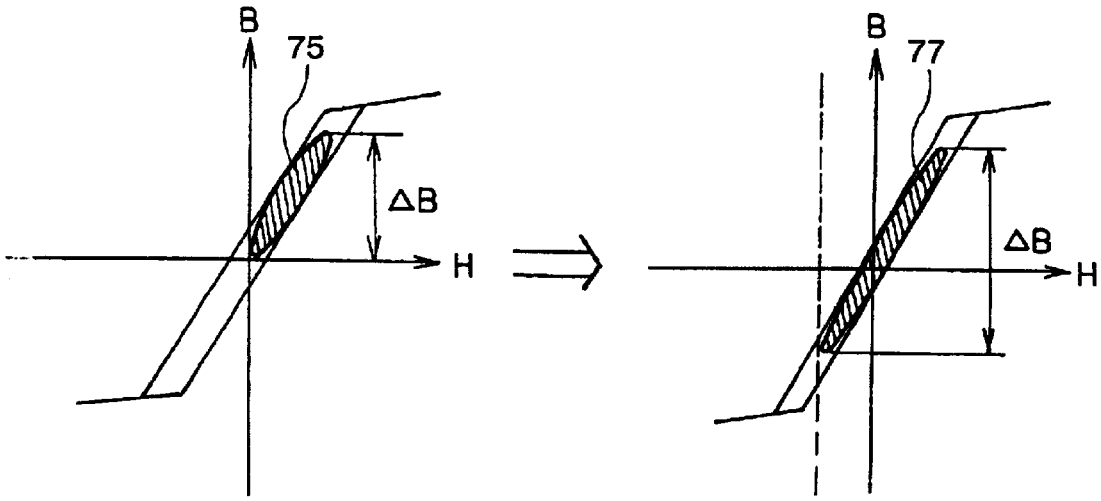
FIG. 18A
PRIOR ART
FIG. 18B

MAGNETIC CORE INCLUDING MAGNET FOR MAGNETIC BIAS AND INDUCTOR COMPONENT USING THE SAME

BACKGROUND OF THE INVENTION

1. Field of the Invention

The present invention relates to a magnetic core (hereafter, may be briefly referred to as "core") of an inductor component, for example, choke coils and transformers. In particular, the present invention relates to a magnetic core including a permanent magnet for magnetic bias.

2. Description of the Related Art

Regarding conventional choke coils and transformers used for, for example, switching power supplies, usually, the alternating current is applied by superimposing on the direct current. Therefore, the magnetic cores used for these choke coils and transformers have been required to have an excellent magnetic permeability characteristic, that is, magnetic saturation with this direct current superimposition does not occur (this characteristic is referred to as "direct current superimposition characteristic").

As high-frequency magnetic cores, ferrite magnetic cores and dust cores have been used. However, the ferrite magnetic core has a high initial permeability and a small saturation magnetic flux density, and the dust core has a low initial permeability and a high saturation magnetic flux density. These characteristics are derived from material properties. Therefore, in many cases, the dust cores have been used in a toroidal shape. On the other hand, regarding the ferrite magnetic cores, the magnetic saturation with direct current superimposition has been avoided, for example, by forming a magnetic gap in a central leg of an E type core.

However, since miniaturization of electronic components has been required accompanying recent request for miniaturization of electronic equipment, magnetic gaps of the magnetic cores must become small, and requirements for magnetic cores having a high magnetic permeability for the direct current superimposition have become intensified.

In general, in order to meet this requirement, magnetic cores having a high saturation magnetization must be chosen, that is, the magnetic cores not causing magnetic saturation in high magnetic fields must be chosen. However, since the saturation magnetization is inevitably determined from a composition of a material, the saturation magnetization cannot be increased infinitely.

A conventionally suggested method for overcoming the aforementioned problem was to cancel the direct current magnetic field due to the direct current superimposition by incorporating a permanent magnet in a magnetic gap formed in a magnetic path of a magnetic core, that is, to apply the magnetic bias to the magnetic core.

This magnetic bias method using the permanent magnet was superior method for improving the direct current superimposition characteristic. However, since when a metal-sintered magnet was used, an increase of core loss of the magnetic core was remarkable, and when a ferrite magnet was used, the superimposition characteristic did not be stabilized, this method could not be put in practical use.

As a method for overcoming the aforementioned problems, for example, Japanese Unexamined Patent Application Publication No. 50-133453 discloses that a rare-earth magnet powder having a high coercive force and a binder were mixed and compression molded to produce a bonded magnet, the resulting bonded magnet was used as a permanent magnet for magnetic bias and, therefore, the direct current superimposition characteristic and an increase in the core temperature were improved.

However, in recent years, requirements for the improvement of power conversion efficiency of the power supply have become even more intensified, and regarding the magnetic cores for choke coils and transformers, superiority or inferiority cannot be determined based on only the measurement of the core temperature. Therefore, evaluation of measurement results using a core loss measurement apparatus is indispensable. As a matter of fact, the inventors of the present invention conducted the research with the result that even when the resistivity was a value indicated in Japanese Unexamined Patent Application Publication No. 50-133453, degradation of the core loss characteristic occurred.

Furthermore, since miniaturization of inductor components has been even more required accompanying recent miniaturization of electronic equipment, requirements for low-profile magnet for magnetic bias have also become intensified.

In recent years, surface-mounting type coils have been required. The coil is subjected to a reflow soldering treatment in order to surface-mount. Therefore, the magnetic core of the coil is required to have characteristics not being degraded under this reflow conditions. In addition, a rare-earth magnet having oxidation resistance is indispensable.

SUMMARY OF THE INVENTION

Accordingly, it is an object of the present invention to provide a magnetic core including a permanent magnet as a magnet for magnetic bias arranged in the neighborhood of a gap in order to supply magnetic bias from both sides of the gap to the magnetic core including at least one gap in a magnetic path with ease at low cost, while, in consideration of the aforementioned circumstances, the aforementioned magnetic core has superior direct current superimposition characteristic, core loss characteristic, and oxidation resistance, and the characteristics are not degraded under reflow conditions.

It is another object of the present invention to provide a magnet especially suitable for miniaturizing the magnetic core including the permanent magnet as a magnet for magnetic bias arranged in the neighborhood of a gap in order to supply magnetic bias from both sides of the gap to the magnetic core including at least one gap in a magnetic path of a miniaturized inductor component.

According to an aspect of the present invention, there is provided a permanent magnet having a resistivity of 0.1 Ω·cm or more. The permanent magnet is a bonded magnet containing a magnet powder dispersed in a resin, and the magnet powder is composed of a powder coated with inorganic glass, and the powder has an intrinsic coercive force of 5 KOe or more, a Curie point Tc of 300° C. or more, and a particle diameter of the powder of 150 μm or less. According to another aspect of the present invention, there is provided a magnetic core which includes a permanent magnet as a magnet for magnetic bias arranged in the neighborhood of a magnetic gap in order to supply magnetic bias from both sides of the gap to the magnetic core including at least one magnetic gap in a magnetic path. Furthermore, another magnetic core including a permanent magnet having a total thickness of 10,000 μm or less and a magnetic gap having a gap length of about 50 to 10,000 μm is provided.

According to still another aspect of the present invention, there is provided an inductor component includes a magnetic core including at least one magnetic gap having a gap length of about 50 to 10,000 μm in a magnetic path, a magnet for magnetic bias arranged in the neighborhood of the magnetic gap in order to supply magnetic bias from both sides of the magnetic gap, and a coil having at least one turn applied to the magnetic core. The magnet for magnetic bias is a bonded magnet containing a resin and a magnet powder dispersed in the resin and having a resistivity of 1 Ω·cm or more. The magnet powder is a rare-earth magnet powder having an intrinsic coercive force of 5 KOe or more, a Curie point of 300° C. or more, a maximum particle diameter of 150 μm or less, and an average particle diameter of 2.5 to 50 μm and coated with inorganic glass. The rare-earth magnet powder is selected from the group consisting of a Sm—Co magnet powder, Nd—Fe—B magnet powder, and Sm—Fe—N magnet powder. Furthermore, another inductor component including a magnetic core and a bonded magnet is provided. The magnetic core includes a magnetic gap having a gap length of about 500 μm or less, and the bonded magnet has a resistivity of 0.1 Ω·cm or more and a thickness of 500 μm or less.

According to yet another aspect of the present invention, there is provided an inductor component to be subjected to a solder reflow treatment. The inductor component includes a magnetic core including at least one magnetic gap having a gap length of about 50 to 10,000 μm in a magnetic path, a magnet for magnetic bias arranged in the neighborhood of the magnetic gap in order to supply magnetic bias from both sides of the magnetic gap, and a coil having at least one turn applied to the magnetic core. The magnet for magnetic bias is a bonded magnet containing a resin and a magnet powder dispersed in the resin and having a resistivity of 1 Ω·cm or more. The magnet powder is a Sm—Co rare-earth magnet powder having an intrinsic coercive force of 10 KOe or more, a Curie point of 500° C. or more, a maximum particle diameter of 150 μm or less, and an average particle diameter of 2.5 to 50 μm and coated with inorganic glass. Furthermore, another inductor component including a magnetic core and a bonded magnet is provided. The magnetic core includes a magnetic gap having a gap length of about 500 μm or less, and the bonded magnet has a resistivity of 0.1 Ω·cm or more and a thickness of 500 μm or less.

According to the present invention, the thickness of the magnet for magnetic bias can be reduced to 500 μm or less. By using this thin plate magnet as a magnet for magnetic bias, miniaturization of the magnetic core can be achieved, and the magnetic core can have superior direct current superimposition characteristic even in high frequencies, core loss characteristic, and oxidation resistance with no degradation under reflow conditions. Furthermore, by using this magnetic core, degradation of the characteristics of the inductor component can be prevented during reflow.

BRIEF DESCRIPTION OF THE DRAWINGS

FIG. 17 is a graph showing measurement data of the direct current superimposed inductance characteristic, in the case where a thin plate magnet is applied and in the case where no thin plate magnet is applied for purposes of comparison, in Example 21;

FIG. 18A is a drawing showing a working region of a core relative to a conventional inductor component;

FIG. 18B is a drawing showing a working region of a core relative to an inductor component including a thin plate magnet according to Example 22 of the present invention;

DESCRIPTION OF THE PREFERRED EMBODIMENTS

Figure 1:
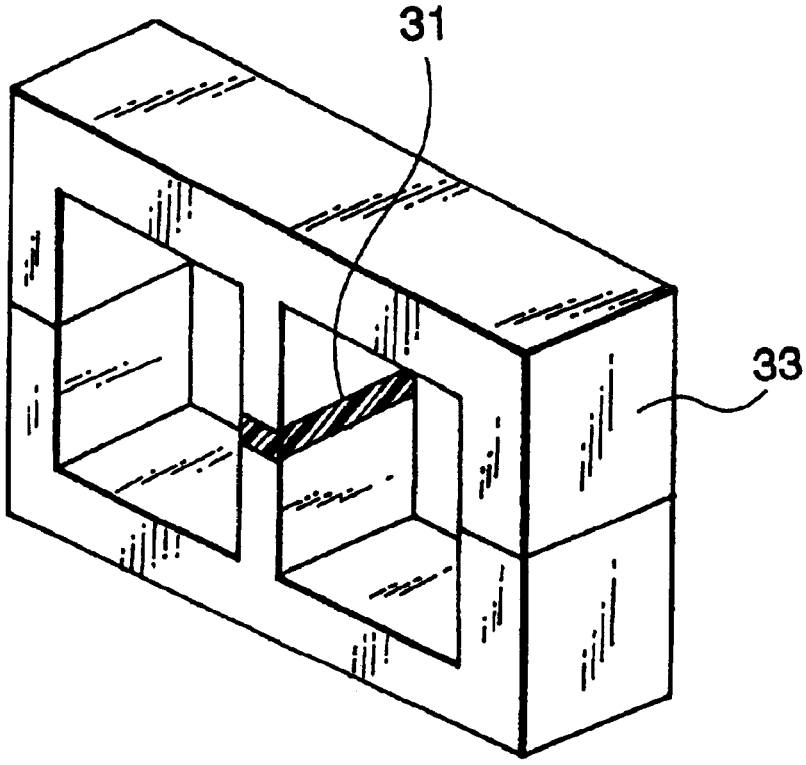
FIG. 1 is a perspective view of a choke coil before application of a coil according to an embodiment of the present invention.

Embodiments according to the present invention will now be specifically described.

A first embodiment according to the present invention relates to a magnetic core including a permanent magnet as a magnet for magnetic bias arranged in the neighborhood of a gap to supply magnetic bias from both sides of the gap to the magnetic core including at least one gap in a magnetic path. In order to overcome the problems, the permanent magnet is specified to be a bonded magnet composed of a rare-earth magnet powder and a resin. The rare-earth magnet powder has an intrinsic coercive force of 10 KOe or more, a Curie point of 500° C. or more, and an average particle diameter of the powder of 2.5 to 50 $\mu$m, and the magnet powder is coated with inorganic glass.

Preferably, the bonded magnet as a magnet for magnetic bias contains the resin at a content of 30% by volume or more and has a resistivity of 1 Ω·cm or more.

The inorganic glass preferably has a softening point of 400° C. or more, but 550° C. or less.

The bonded magnet preferably contains the aforementioned inorganic glass for coating the aforementioned magnet powder at a content of 10% by weight or less.

The rare-earth magnet powder is preferably a $Sm_2Co_{17}$ magnet powder.

The present embodiment according to the present invention further relates to an inductor component including the magnetic core. In the inductor component, at least one coil having at least one turn is applied to the magnetic core including a magnet for magnetic bias.

The inductor components include coils, choke coils, transformers, and other components indispensably including, in general, a magnetic core and a coil.

The first embodiment according to the present invention further relates to a permanent magnet inserted into the magnetic core. As a result of the research on the permanent magnet, superior direct current superimposition characteristic could be achieved when the permanent magnet for use had a resistivity of 1 Ω·cm or more and an intrinsic coercive force iHc of 10 KOe or more, and furthermore, a magnetic core having a core loss characteristic with no occurrence of degradation could be formed. This is based on the finding of the fact that the magnet characteristic necessary for achieving superior direct current superimposition characteristic is an intrinsic coercive force rather than an energy product and, therefore, sufficiently high direct current superimposition characteristic can be achieved as long as the intrinsic coercive force is high, even when a permanent magnet having a low energy product is used.

The magnet having a high resistivity and high intrinsic coercive force can be generally achieved by a rare-earth bonded magnet. The rare-earth bonded magnet is produced by mixing the rare-earth magnet powder and a binder and by molding the resulting mixture. However, any composition may be used as long as the magnet powder has a high coercive force. The kind of the rare-earth magnet powder may be any of SmCo-base, NdFeB-base, and SmFeN-base.

In consideration of reflow conditions and oxidation resistance, the magnet must has a Curie point Tc of 500° C. or more and an intrinsic coercive force iHc of 10 KOe or more. Therefore, a $Sm_2Co_{17}$ magnet is preferred under present circumstances.

Any material having a soft magnetic characteristic may be effective as the material for the magnetic core for a choke coil and transformer, although, in general, MnZn ferrite or NiZn ferrite, dust cores, silicon steel plates, amorphous, etc., are used. The shape of the magnetic core is not specifically limited and, therefore, the present invention can be applied to magnetic cores having any shape, for example, toroidal cores, EE cores, and EI cores. The core includes at least one gap in the magnetic path, and a permanent magnet is inserted into the gap.

The gap length is not specifically limited, although when the gap length is excessively reduced, the direct current superimposition characteristic is degraded, and when the gap length is excessively increased, the magnetic permeability is excessively reduced and, therefore, the gap length to be formed is inevitably determined. When the thickness of the permanent magnet for magnetic bias is increased, a bias effect can be achieved with ease, although in order to miniaturize the magnetic core, the thinner permanent magnet for magnetic bias is preferred. However, when the gap is less than 50 $\mu$m, sufficient magnetic bias cannot be achieved. Therefore, The magnetic gap for arranging the permanent magnet for magnetic bias must be 50 $\mu$m or more, but from the viewpoint of reduction of the core size, the magnetic gap is preferably 10,000 $\mu$m or less.

Regarding the characteristics required of the permanent magnet to be inserted into the gap, when the intrinsic coercive force is 10 KOe or less, the coercive force disappears due to a direct current magnetic field applied to the magnetic core and, therefore, the coercive force is required to be 10 KOe or more. The greater resistivity is the better. However, the resistivity does not become a primary factor of degradation of the core loss as long as the resistivity is 1 Ω·cm or more. When the average maximum particle diameter of the powder becomes 50 $\mu$m or more, the core loss characteristic is degraded and, therefore, the maximum average particle diameter of the powder is preferably 50 $\mu$m or less. When the minimum particle diameter becomes 2.5 $\mu$m or less, the magnetization is reduced remarkably due to oxidation of the magnetic powder during heat treatment of the magnetic powder and reflow of the core and the inductor component. Therefore, the particle diameter must be 2.5 μm or more.

Regarding a problem of thermal demagnetization due to heat generation of the coil, since a predicted maximum operating temperature of the transformer is 200° C., if the Tc is 500° C. or more, substantially no problem will occur. In order to prevent increase in core loss, the content of the resin is preferably at least 30% by volume. When the inorganic glass for improving the oxidation resistance has a softening point of 400° C. or more, coating of the inorganic glass is not destructed during reflow operation or at the maximum operating temperature, and when the softening point is 550° C. or less, a problem of oxidation of the powder does not occur remarkably during coating and heat treatment. Furthermore, an effect of oxidation resistance can be achieved by adding inorganic glass. However, when the addition amount exceeds 10% by weight, since an improvement of the direct current superimposition characteristic is reduced due to an increase in the amount of non-magnetic material, the upper limit is preferably 10% by weight.

Examples according to the first embodiment of the present invention will be described below.

EXAMPLE 1

Six kinds of glass powders were prepared. These were $ZnO—B_2O_3—PbO$ (1) having a softening point of about 350° C., $ZnO—B_2O_3—PbO$ (2) having a softening point of about 400° C., $B_2O_3—PbO$ having a softening point of about 450° C., $K_2O—SiO_2—PbO$ having a softening point of about 500° C., $SiO_2—B_2O_3—PbO$ (1) having a softening point of about 550° C., and $SiO_2—B_2O_3—PbO$ (2) having a softening point of about 600° C. Each powder had a particle diameter of about 3 μm.

A $Sm_2Co_{17}$ magnet powder was produced as the magnet powder from a sintered material by pulverization. That is, a $Sm_2Co_{17}$ sintered material was produced by a common powder metallurgy process. Regarding the magnetic characteristics of the resulting sintered material, the (BH) max was 28 MGOe, and the coercive force was 25 KOe. This sintered material was roughly pulverized with a jaw crusher, disk mill, etc., and thereafter, was pulverized with a ball mill so as to have an average particle diameter of about 5.0 μm.

Each of the resulting magnet powders was mixed with the respective glass powders at a content of 1%. Each of the resulting mixtures was heat-treated in Ar at a temperature about 50° C. higher than the softening point of the glass powder and, therefore, the surface of the magnet powder was coated with the glass. The resulting coating-treated magnet powder was kneaded with 45% by volume of poly(phenylene sulfide) (PPS) as a thermoplastic resin with a twin-screw hot kneader at 330° C. Subsequently, molding was performed with a hot-pressing machine at a molding temperature of 330° C. at a pressure of 1 t/cm$^2$ without magnetic field so as to produce a sheet-type bonded magnet having a height of 1.5 mm. Each of the resulting sheet-type bonded magnets had the resistivity of 1 Ω·cm or more. This sheet-type bonded magnet was processed to have the same cross-sectional shape with the central magnetic leg of a ferrite core 33 shown in FIGS. 1 and 2.

The magnetic characteristics of the bonded magnet were measured with a BH tracer using a test piece. The test piece was prepared separately by laminating and bonding proper number of the resulting sheet-type bonded magnets to have a diameter of 10 mm and a thickness of 10 mm. As a result, each of the bonded magnets had an intrinsic coercive force of about 10 KOe or more.

The ferrite core 33 was an EE core made of a common MnZn ferrite material and having a magnetic path length of 7.5 cm and an effective cross-sectional area of 0.74 cm$^2$. The central magnetic leg of the EE core was processed to have a gap of 1.5 mm. The bonded magnet 31 produced as described above was pulse-magnetized in a magnetizing magnetic field of 4 T, and the surface magnetic flux was measured with a gauss meter. Thereafter the bonded magnet 31 was inserted into the gap portion of the core 33. A core loss characteristic was measured with a SY-8232 alternating current BH tracer manufactured by Iwatsu Electric Co., Ltd., under the conditions of 100 KHz and 0.1 T at room temperature. Herein, the same ferrite core was used in the measurements regarding each of the bonded magnets, and the core losses were measured while only the magnet 31 was changed to other magnet having a coating of different kind of glass. The measurement results thereof are shown in the "Before heat treatment" column in Table 1.

Thereafter, those bonded magnets were passed twice through a reflow furnace having a maximum temperature of 270° C., and subsequently, the surface magnetic flux and the core loss were measured in a manner similar to those in the above description. The measurement results thereof are shown in the "After heat treatment" column in Table 1.

TABLE 1

| | coating | before heat treatment | | after heat treatment | |
|---|---|---|---|---|---|
| glass composition | temperature (° C.) | surface flux | core loss | surface flux | core loss |
| $ZnO—B_2O_3—PbO(1)$ | 400 | 310 | 120 | 180 | 300 |
| $ZnO—B_2O_3—PbO(2)$ | 450 | 300 | 100 | 290 | 110 |
| $B_2O_3—PbO$ | 500 | 290 | 110 | 280 | 120 |
| $K_2O—SiO_2—PbO$ | 550 | 305 | 100 | 295 | 110 |
| $SiO_2—B_2O_3—PbO(1)$ | 600 | 300 | 120 | 290 | 110 |
| $SiO_2—B_2O_3—PbO(2)$ | 650 | 240 | 100 | 220 | 110 |

As is clearly shown in Table 1, data at coating-treatment temperatures of 650° C. and 600° C. show that when the coating-treatment temperature exceeds 600° C., the surface magnetic flux is decreased. Regarding the core loss, when the coating-treatment temperature is 400° C., that is, when the glass composition having a softening point of 350° C. is used for coating, the surface magnetic flux is degraded after the reflow. The reason for the degradation is believed to be that the glass powder having a softening point of 350° C. is applied once by the coating treatment, and thereafter is melted again and peeled off during the hot kneading with the resin. On the other hand, regarding the glass having a softening point exceeding 600° C., the reason for the demagnetization is believed to be that since the coating-treatment temperature is excessively increased, contribution of the magnet powder to the magnetization is reduced due to oxidation of the magnet powder or reaction of the magnet powder with the coating glass.

Then, an inductance L was measured with a LCR meter when an alternating current signal was applied to the coil (indicated by 35 in FIG. 2) while a direct current corresponding to direct current magnetic field of 80 (Oe) was superimposed, and a magnetic permeability was calculated based on the core constants (size) and the number of turns of the coil. As a result, the magnetic permeability of each of the cores was 50 or more in the case where the magnet powder was coated with a glass powder having a softening point within the range of 400° C. ($ZnO—B_2O_3—PbO$ (2)) to 550° C. ($SiO_2—B_2O_3—PbO$ (1)), and the core included the bonded magnet containing the magnet powder and inserted into the magnetic gap. On the other hand, as comparative examples, the magnetic permeability of each of the cores was very low as 15 in the case where the magnet core included no magnet inserted into the magnetic gap and in the case where the magnet powder was coated with a glass powder having a softening point of 350° C. ($ZnO—B_2O_3—PbO$ (1)) or 600° C. ($SiO_2—B_2O_3—PbO$ (2)), and the core included the bonded magnet containing the glass powder and inserted into the magnetic gap.

As is clear from the aforementioned results, superior magnetic core can be achieved, and the magnetic core has superior direct current superimposition characteristic and core loss characteristic with reduced degradation, when the permanent magnet is a bonded magnet using a magnet powder coated with a glass powder having a softening point of 400° C. or more, but 550° C. or less, the permanent magnet has a resistivity of 1 Ω·cm or more, and the permanent magnet is inserted into the magnetic gap of the magnetic core.

EXAMPLE 2

A magnet powder and a glass powder were mixed in order that each of the resulting mixtures had a glass powder content of 0.1%, 0.5%, 1.0%, 2.5%, 5.0%, 7.5%, 10%, or 12.5% by weight. The magnet powder was the $Sm_2Co_{17}$ magnet powder used in Example 1, and the glass powder was a $SiO_2—B_2O_3—PbO$ glass powder of about 3 μm having a softening point of about 500° C. Each of the resulting mixtures was heat-treated at 550° C. in Ar and, therefore, the magnet powder was coated with glass. The magnet powder coated with glass was mixed with 50% by volume of polyimide resin as a binder, and the resulting mixture was made into a sheet by a doctor blade method. The resulting sheet was dried to remove the solvent, and thereafter, was molded by hot press to have a thickness of 0.5 mm.

The magnetic characteristics of this bonded magnet were measured using a separately prepared test piece in a manner similar to that in Example 1. As a result, each of the bonded magnets exhibited an intrinsic coercive force of about 10 KOe or more regardless of the amount of the glass powder mixed into the magnet powder. Furthermore, as a result of the resistivity measurement, each of the bonded magnets exhibited a value of 1 Ω·cm or more.

Subsequently, in a manner similar to that in Example 1, the sheet type bonded magnet was magnetized, and the surface magnetic flux was measured. Thereafter, the bonded magnet was inserted into the magnetic gap of the central magnetic leg of the ferrite EE core 33 shown in FIGS. 1 and 2, and the direct current superimposition characteristic was measured under a superimposed application of alternating current and direct current to the coil 35 in a manner similar to that in Example 1. Furthermore, the core was passed twice through a reflow furnace, at a temperature with maximum temperature of 270° C., exactly similar to that in Example 1, and the surface magnetic flux and direct current superimposition characteristic were measured again. The result of the surface magnetic flux is shown in Table 2, and the result of the direct current superimposition characteristic is shown in Table 3.

TABLE 2

| surface | content of glass powder (wt %) | | | | | | | | |
|---|---|---|---|---|---|---|---|---|---|
| flux | 0 | 0.1 | 0.5 | 1.0 | 2.5 | 5.0 | 7.5 | 10.0 | 12.5 |
| before heat treatment | 300 | 290 | 295 | 305 | 300 | 290 | 280 | 250 | 200 |
| after heat treatment | 175 | 275 | 285 | 295 | 290 | 280 | 270 | 240 | 190 |

TABLE 3

| weight | content of glass powder (wt %) | | | | | | | | |
|---|---|---|---|---|---|---|---|---|---|
| characteristic | 0 | 0.1 | 0.5 | 1.0 | 2.5 | 5.0 | 7.5 | 10.0 | 12.5 |
| before heat treatment | 75 | 71 | 73 | 77 | 75 | 72 | 70 | 50 | 30 |
| after heat treatment | 25 | 68 | 71 | 75 | 73 | 70 | 68 | 45 | 20 |

As is clearly shown in Tables 2 and 3, the magnet having oxidation resistance and other superior characteristics can be achieved when the content of the added glass powder is substantially more than 0, but less than 10% by weight.

As described above, the magnetic core having superior direct current superimposition characteristic, core loss characteristic, and oxidation resistance can be realized when the magnetic core includes at least one gap in the magnetic path, the magnet for magnetic bias to be inserted into the magnetic gap is a bonded magnet using the rare-earth magnet powder having an intrinsic coercive force iHc of 10 KOe or more, a Curie point Tc of 500° C. or more, and a particle diameter of the powder of 2.5 to 50 μm. The surface of the magnet powder is coated with inorganic glass, and the bonded magnet is composed of the magnet powder and at least 30% by volume of resin, and has a resistivity of 1 Ω·cm or more.

Next, another embodiment according to the present invention will now be described.

A second embodiment according to the present invention relates to a magnetic core including a permanent magnet as a magnet for magnetic bias arranged in the neighborhood of a gap to supply magnetic bias from both sides of the gap to the magnetic core including at least one gap in a magnetic path. In order to overcome the problems, the permanent magnet is specified to be a bonded magnet composed of a rare-earth magnet powder and a resin. The rare-earth magnet powder has an intrinsic coercive force of 5 KOe or more, a Curie point of 300° C. or more, and an average particle diameter of the powder of 2.0 to 50 μm, and the magnet powder is coated with inorganic glass.

Preferably, the bonded magnet as a magnet for magnetic bias contains the aforementioned resin at a content of 30% by volume or more and has a resistivity of 1 Ωcm or more.

The inorganic glass preferably has a softening point of 200° C. or more, but 550° C. or less.

The bonded magnet preferably contains the inorganic glass for coating the magnet powder at a content of 10% by weight or less.

The present embodiment further relates to an inductor component including the aforementioned magnetic core. In the inductor component, at least one coil each of which has at least one turn is applied to the magnetic core including a magnet for magnetic bias.

The inductor components include coils, choke coils, transformers, and other components indispensably including, in general, a magnetic core and a coil.

In the present embodiment, the research was conducted regarding a permanent magnet to be inserted in order to overcome the aforementioned problems. As a result, superior direct current superimposition characteristic could be achieved when the permanent magnet for use had a resistivity of 1 Ω·cm or more and an intrinsic coercive force iHc of 5 KOe or more, and furthermore, a magnetic core having a core loss characteristic with no occurrence of degradation could be formed. This is based on the finding of the fact that the magnet characteristic necessary for achieving superior direct current superimposition characteristic is an intrinsic coercive force rather than an energy product and, therefore, sufficiently high direct current superimposition characteristic can be achieved as long as the intrinsic coercive force is high, even when a permanent magnet having a low energy product is used.

The magnet having a high resistivity and high intrinsic coercive force can be generally achieved by a rare-earth bonded magnet, and the rare-earth bonded magnet is produced by mixing the rare-earth magnet powder and a binder and by molding the resulting mixture. However, any composition may be used as long as the magnet powder has a high coercive force. The kind of the rare-earth magnet powder may be any of SmCo-base, NdFeB-base, and SmFeN-base.

Any material having a soft magnetic characteristic may be effective as the material for the magnetic core for a choke coil and transformer, although, in general, MnZn ferrite or NiZn ferrite, dust cores, silicon steel plates, amorphous, etc., are used. The shape of the magnetic core is not specifically limited and, therefore, the present invention can be applied to magnetic cores having any shape, for example, toroidal cores, EE cores, and EI cores. The core includes at least one gap in the magnetic path, and a permanent magnet is inserted into the gap.

The gap length is not specifically limited, although when the gap length is excessively reduced, the direct current superimposition characteristic is degraded, and when the gap length is excessively increased, the magnetic permeability is excessively reduced and, therefore, the gap length to be formed is inevitably determined. When the thickness of the permanent magnet for magnetic bias is increased, a bias effect can be achieved with ease, although in order to miniaturize the magnetic core, the thinner permanent magnet for magnetic bias is preferred. However, when the gap is less than 50 μm, sufficient magnetic bias cannot be achieved. Therefore, the magnetic gap for arranging the permanent magnet for magnetic bias must be 50 μm or more, but from the viewpoint of reduction of the core size, the magnetic gap is preferably 10,000 μm or less.

Regarding the characteristics required of the permanent magnet to be inserted into the gap, when the intrinsic coercive force is 5 KOe or less, the coercive force disappears due to a direct current magnetic field applied to the magnetic core and, therefore, the coercive force is required to be 5 KOe or more. The greater resistivity is the better. However, the resistivity does not become a primary factor of degradation of the core loss as long as the resistivity is 1 Ωcm or more. When the average maximum particle diameter of the powder becomes 50 μm or more, the core loss characteristic is degraded and, therefore, the maximum average particle diameter of the powder is preferably 50 μm or less. When the minimum particle diameter becomes 2.0 μm or less, the magnetization is reduced remarkably due to oxidation of the magnetic powder during pulverization. Therefore, the particle diameter must be 2.0 μm or more.

Regarding a problem of thermal demagnetization due to heat generation of the coil, since predicted maximum operating temperature of the transformer is 200° C., if the Tc is 300° C. or more, substantially no problem will occur. In order to prevent increase in core loss, the content of the resin is preferably at least 20% by volume. When the inorganic glass for improving the oxidation resistance has a softening point of 250° C. or more, coating of the inorganic glass is not destructed at the maximum working temperature, and when the softening point is 550° C. or less, a problem of oxidation of the powder does not occur remarkably during coating and heat treatment. Furthermore, an effect of oxidation resistance can be achieved by adding inorganic glass. However, when the addition amount exceeds 10% by weight, since an improvement of the direct current superimposition characteristic is reduced due to an increase in the amount of non-magnetic material, the upper limit is preferably 10% by weight.

Examples according to the second embodiment of the present invention will be described below.

EXAMPLE 3

Six kinds of glass powders were prepared. These were $ZnO—B_2O_3—PbO$ (1) having a softening point of about 350° C., $ZnO—B_2O_3—PbO$ (2) having a softening point of about 400° C., $B_2O_3—PbO$ having a softening point of about 450° C., $K_2O—SiO_2—PbO$ having a softening point of about 500° C., $SiO_2—B_2O_3—PbO$ (1) having a softening point of about 550° C., and $SiO_2—B_2O_3—PbO$ (2) having a softening point of about 600° C. Each powder had a particle diameter of about 3 μm.

Regarding the preparation of a $Sm_2Co_{17}$ magnet powder, an ingot was pulverized and sintered by a common powder metallurgy process so as to produce a sintered material. The resulting sintered material was finely pulverized into 2.3 μm. The magnetic characteristic of the resulting magnet powder was measured with VSM, and as a result, the coercive force iHc was about 9 KOe.

Each of the resulting magnet powders was mixed with the respective glass powders at a content of 1%. Each of the resulting mixtures was heat-treated in Ar at a temperature about 50° C. higher than the softening point of the glass powder and, therefore, the surface of the magnet powder was coated with the glass. The resulting coating-treated magnet powder was kneaded with 45% by volume of 6-nylon as a thermoplastic resin with a twin-screw hot kneader at 220° C. Subsequently, molding was performed with a hot-pressing machine at a molding temperature of 220° C. at a pressure of 0.05 $\mu t/cm^2$ without magnetic field so as to produce a sheet-type bonded magnet having a height of 1.5 mm. Each of the resulting sheet-type bonded magnets had the resistivity of 1 Ω·cm or more. This sheet-type bonded magnet was processed to have the same cross-sectional shape with the central magnetic leg of a ferrite core 33 similar to that shown in FIGS. 1 and 2.

The magnetic characteristics of the bonded magnet were measured with a BH tracer using a test piece. The test piece was prepared separately by laminating and bonding proper number of the resulted sheet-type bonded magnets to have a diameter of 10 mm and a thickness of 10 mm. As a result, each of the bonded magnets had an intrinsic coercive force of about 9 KOe or more.

The ferrite core 33 was an EE core made of a common MnZn ferrite material and having a magnetic path length of 7.5 cm and an effective cross-sectional area of 0.74 $cm^2$. The central magnetic leg of the EE core was processed to have a gap of 1.5 mm. The bonded magnet 31 produced as described above was pulse-magnetized in a magnetizing magnetic field of 4 T, and the surface magnetic flux was measured with a gauss meter. Thereafter the bonded magnet 31 was inserted into the gap portion. A core loss characteristic was measured with a SY-8232 alternating current BH tracer manufactured by Iwatsu Electric Co., Ltd., under the conditions of 100 KHz and 0.1 T at room temperature. Herein, the same ferrite core was used in the measurements regarding each of the bonded magnets, and the core losses were measured while only the magnet 31 was changed to other magnet having a coating of different kind of glass. The measurement results thereof are shown in the "Before heat treatment" column in Table 4.

Thereafter, since a predicted maximum operating temperature of the transformer was 200° C., those bonded magnets were kept in a thermostatic chamber at 200° C. for net keeping time of 30 minutes, and subsequently, the surface magnetic flux and the core loss were measured in a manner similar to those in the above description. The measurement results thereof are shown in the "After heat treatment" column in Table 4.

TABLE 4

| | coating | before heat treatment | | after heat treatment | |
|---|---|---|---|---|---|
| glass composition | temperature (° C.) | surface flux | core loss | surface flux | core loss |
| $ZnO—B_2O_3—PbO(1)$ | 400 | 220 | 110 | 210 | 120 |
| $ZnO—B_2O_3—PbO(2)$ | 450 | 210 | 90 | 200 | 100 |
| $B_2O_3—PbO$ | 500 | 200 | 100 | 190 | 110 |
| $K_2O—SiO_2—PbO$ | 550 | 215 | 90 | 205 | 100 |
| $SiO_2—B_2O_3—PbO(1)$ | 600 | 210 | 110 | 200 | 120 |
| $SiO_2—B_2O_3—PbO(2)$ | 650 | 150 | 90 | 130 | 100 |

As is clearly shown in Table 4, data at coating-treatment temperatures of 650° C. and 600° C. show that when the coating-treatment temperature exceeds 600° C., the surface magnetic flux is decreased. Regarding coatings of any glass composition, degradation of the core loss is not observed. Therefore, regarding the glass having a softening point exceeding 600° C., the reason for the demagnetization is believed to be that since the coating-treatment temperature is excessively increased, contribution of the magnet powder to the magnetization is reduced due to oxidation of the magnet powder or reaction of the magnet powder with the coating glass.

Figure 2:
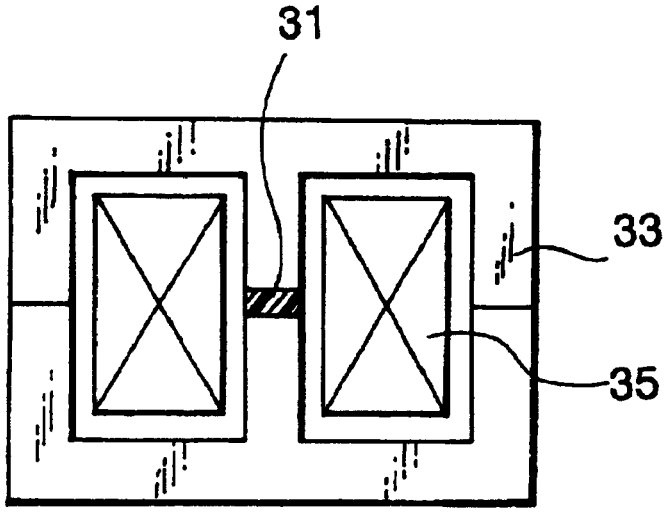
FIG. 2 is a front view of the choke coil shown in FIG. 1.
Figure 3:
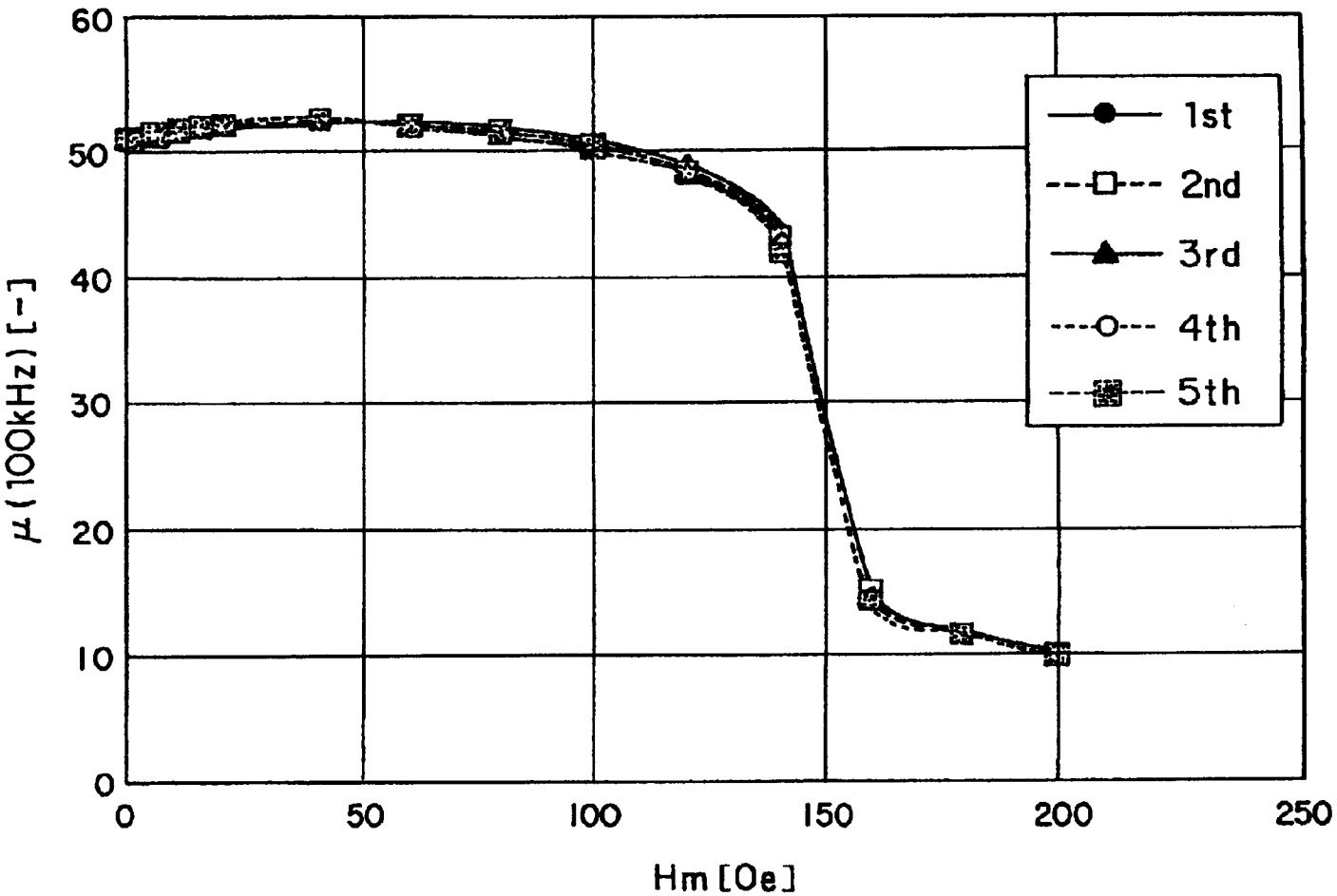
FIG. 3 is a graph showing measurement data of the direct current superimposition characteristic regarding a thin plate magnet composed of a $Sm_2Co_{17}$ magnet and a polyimide resin in Example 6.
Figure 4:
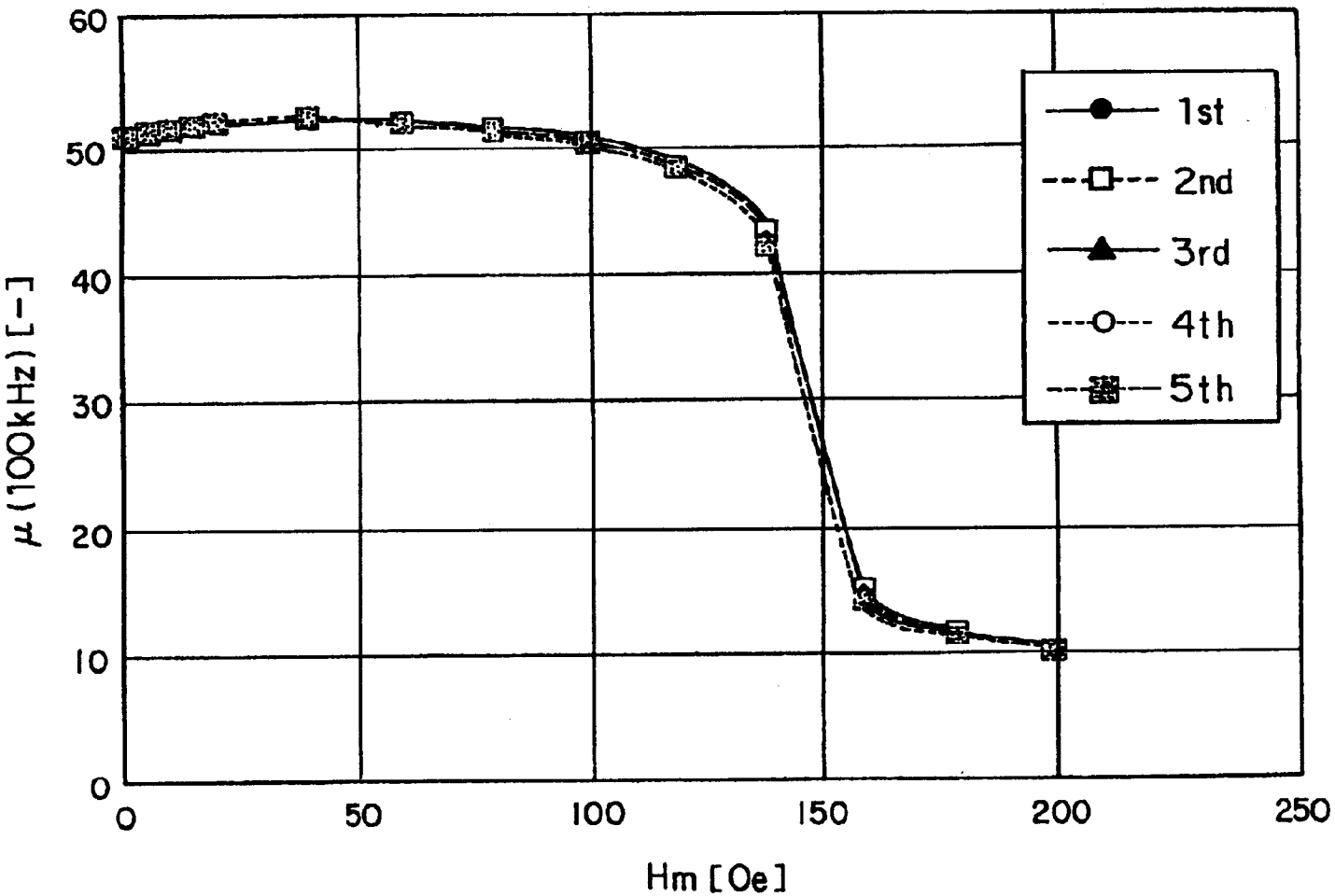
FIG. 4 is a graph showing measurement data of the direct current superimposition characteristic regarding a thin plate magnet composed of a $Sm_2Co_{17}$ magnet and an epoxy resin in Example 6.
Figure 5:
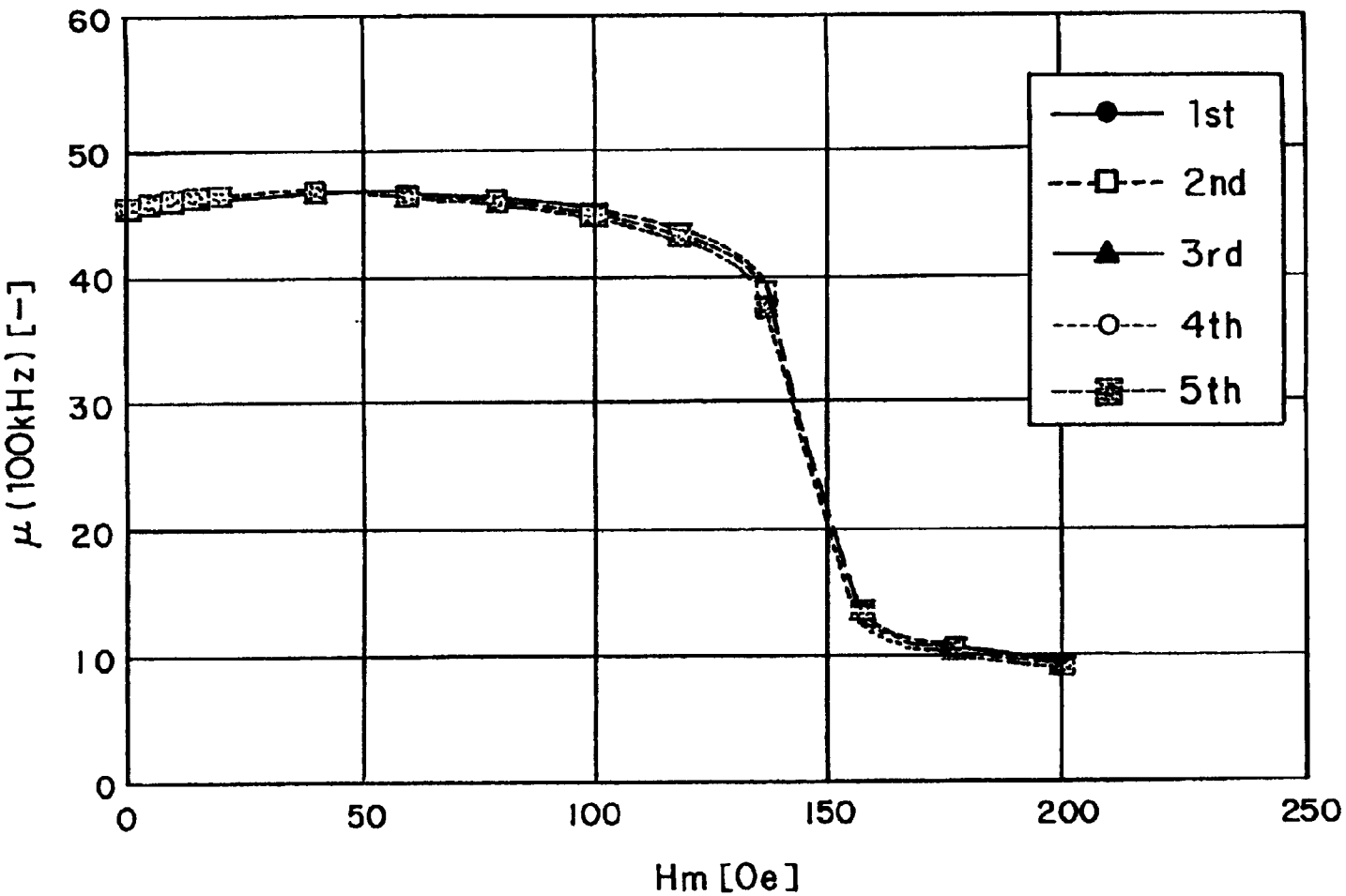
FIG. 5 is a graph showing measurement data of the direct current superimposition characteristic regarding a thin plate magnet composed of a $Sm_2Co_{17}N$ magnet and a polyimide resin in Example 6.
Figure 6:
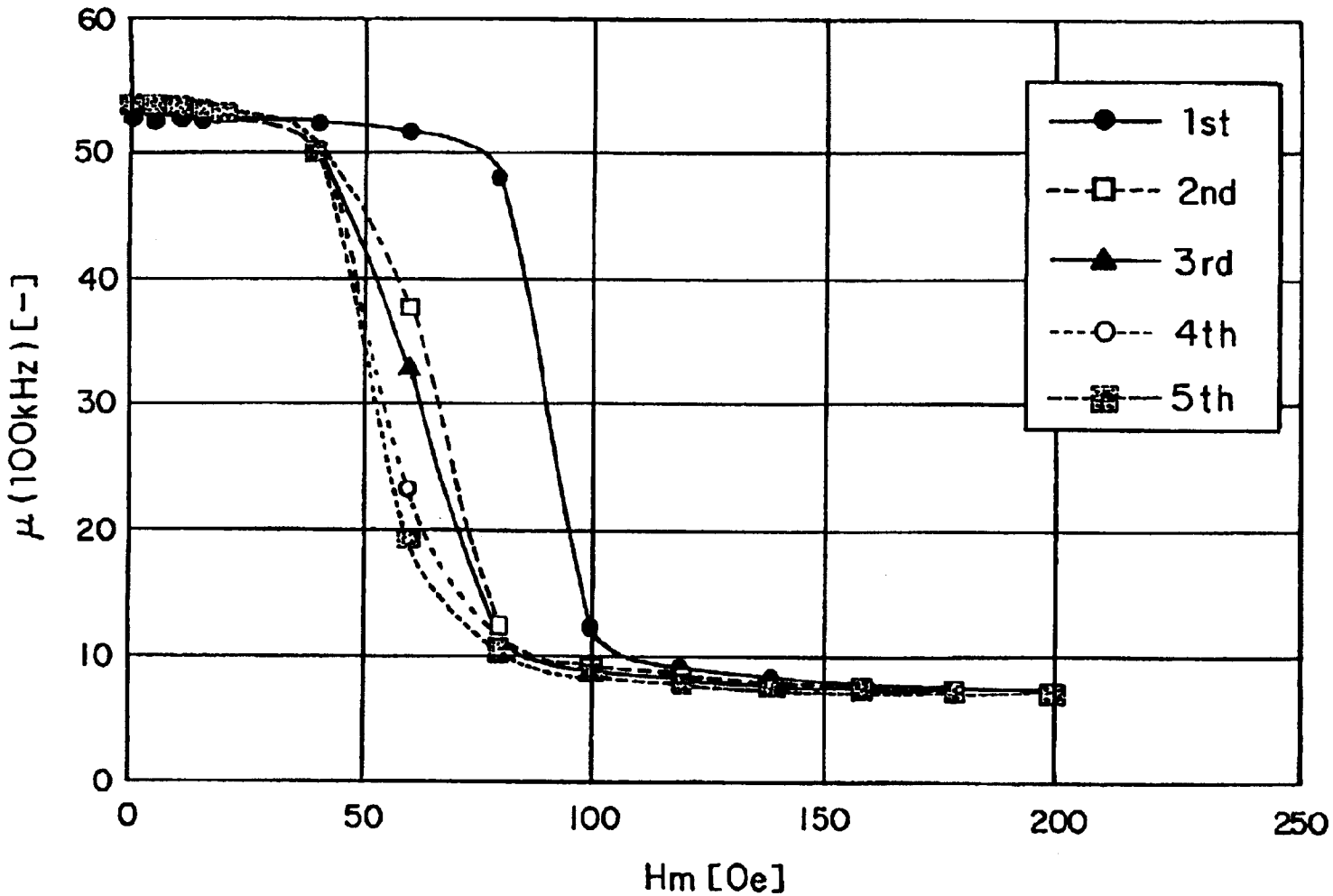
FIG. 6 is a graph showing measurement data of the direct current superimposition characteristic regarding a thin plate magnet composed of a Ba ferrite magnet and a polyimide resin in Example 6.

Then, an inductance L was measured with a LCR meter when an alternating current signal was applied to the coil, as indicated by 35 in FIG. 2, while a direct current corresponding to direct current magnetic field of 80 (Oe) was superimposed, and a magnetic permeability was calculated based on the core constants (size) and the number of turns of the coil. As a result, the magnetic permeability of each of the cores was 50 or more in the case where the magnet powder was coated with a glass powder having a softening point within the range of 350° C. ($ZnO—B_2O_3—PbO$ (1)) to 550° C. ($SiO_2—B_2O_3—PbO$ (1)), and the core included the bonded magnet containing the magnet powder and inserted into the magnetic gap. On the other hand, as comparative examples, the magnetic permeability of each of the cores was very low as 15 in the case where the magnet core included no magnet inserted into the magnetic gap and in the case where the magnet powder was coated with a glass powder having a softening point of 600° C. ($SiO_2—B_2O_3—PbO$ (2)), and the core included the bonded magnet containing the glass powder and inserted into the magnetic gap.

As is clear from the results, superior magnetic core can be achieved, and the magnetic core has superior direct current superimposition characteristic and core loss characteristic with reduced degradation, when the permanent magnet is a bonded magnet using a magnet powder coated with a glass powder having a softening point of 550° C. or less, the permanent magnet has a resistivity of 1 Ω·cm or more, and the permanent magnet is inserted into the magnetic gap of the magnetic core.

EXAMPLE 4

A SmFe powder produced by a reduction and diffusion method was finely pulverized into 3 μm, and subsequently, a nitriding treatment was performed and, therefore, a SmFeN powder was prepared as a magnet powder. The magnetic characteristic of the resulting magnet powder was measured with VSM, and as a result, the coercive force iHc was about 8 KOe.

The resulting magnet powder and a glass powder were mixed in order that each of the resulting mixtures had a glass powder content of 0.1%, 0.5%, 1.0%, 2.5%, 5.0%, 7.5%, 10%, or 12.5% by weight. The glass powder was a $ZnO—B_2O_3—PbO$ glass powder of about 3 μm having a softening point of about 350° C. Each of the resulting mixtures was heat-treated at 400° C. in Ar and, therefore, the magnet powder was coated with glass. The magnet powder coated with glass was mixed with 30% by volume of epoxy resin as a binder, and the resulting mixture was die-molded into a sheet having the same cross-sectional shape with the central magnetic leg of the ferrite core 33 shown in FIGS. 1 and 2. The resulting sheet was cured at 150° C. and, therefore, a bonded magnet was formed.

The magnetic characteristics of this bonded magnet were measured using a separately prepared test piece in a manner similar to that in Example 3. As a result, each of the bonded magnets exhibited an intrinsic coercive force of about 8 KOe regardless of the amount of the glass powder mixed into the magnet powder. Furthermore, as a result of the resistivity measurement, each of the bonded magnets exhibited a value of 1 Ω·cm or more.

Subsequently, in the same manner with that in Example 3, the sheet type bonded magnet was magnetized, and the surface magnetic flux was measured. Thereafter, the bonded magnet was inserted into the magnetic gap of the central magnetic leg of the ferrite EE core 33 shown in FIGS. 1 and 2, and the direct current superimposition characteristic was measured under a superimposed application of alternating current and direct current to the coil 35 in a manner similar to that in Example 3.

Furthermore, those bonded magnets were kept in a thermostatic chamber at 200° C. substantially for 30 minutes in a manner exactly similar to that in Example 3, and subsequently, the surface magnetic flux and direct current superimposition characteristic were measured again. The result of the surface magnetic flux is shown in Table 5, and the result of the direct current superimposition characteristic is shown in Table 6.

TABLE 5

| surface | content of glass powder (wt %) | | | | | | | | |
|---|---|---|---|---|---|---|---|---|---|
| flux | 0 | 0.1 | 0.5 | 1.0 | 2.5 | 5.0 | 7.5 | 10.0 | 12.5 |
| before heat treatment | 310 | 300 | 305 | 315 | 310 | 300 | 290 | 260 | 190 |
| after heat treatment | 200 | 285 | 295 | 305 | 300 | 290 | 280 | 250 | 180 |

TABLE 6

| weight | content of glass powder (wt %) | | | | | | | | |
|---|---|---|---|---|---|---|---|---|---|
| characteristic | 0 | 0.1 | 0.5 | 1.0 | 2.5 | 5.0 | 7.5 | 10.0 | 12.5 |
| before heat treatment | 77 | 73 | 75 | 79 | 77 | 74 | 72 | 52 | 23 |
| after heat treatment | 24 | 70 | 73 | 77 | 75 | 72 | 70 | 47 | 20 |

As is clearly shown in Tables 5 and 6, the magnet having oxidation resistance and other superior characteristics can be achieved when the content of the added glass powder is substantially more than 0, but less than 10% by weight.

As described above, according to the second embodiment of the present invention, the magnetic core having superior direct current superimposition characteristic, core loss characteristic, and oxidation resistance can be realized when the magnetic core includes at least one gap in the magnetic path, the magnet for magnetic bias to be inserted into the magnetic gap is a bonded magnet using the rare-earth magnet powder having an intrinsic coercive force iHc of 5 KOe or more, a Curie point Tc of 300° C. or more, and a particle diameter of the powder of 2.0 to 50 μm, the surface of the magnet powder is coated with inorganic glass, and the bonded magnet is composed of the magnet powder and at least 20% by volume of resin, and has a resistivity of 1 Ω·cm or more.

Next, another embodiment according to the present invention will now be described.

A third embodiment according to the present invention relates to a thin plate magnet having a total thickness of 500 μm or less. The thin plate magnet is composed of a resin and a magnet powder dispersed in the resin. The resin is selected from the group consisting of poly(amide-imide) resins, polyimide resins, epoxy resins, poly(phenylene sulfide) resins, silicone resins, polyester resins, aromatic polyamides, and liquid crystal polymers, and the content of the resin is 30% by volume or more.

Herein, preferably, the magnet powder has an intrinsic coercive force iHc of 10 KOe or more, a Curie point Tc of 500° C. or more, and a particle diameter of the powder of 2.5 to 50 μm.

Regarding the thin plate magnet, preferably, the magnet powder is a rare-earth magnet powder, and a surface glossiness is 25% or more.

The thin plate magnet preferably has a molding compressibility of 20% or more. Preferably, the magnet powder is coated with a surfactant.

The thin plate magnet according to the present embodiment preferably has a resistivity of 0.1 Ω·cm or more.

The present embodiment further relates to a magnetic core including permanent magnet as a magnet for magnetic bias arranged in the neighborhood of the magnetic gap to supply magnetic bias from both sides of the gap to the magnetic core including at least one magnetic gap in a magnetic path. The permanent magnet is specified to be the aforementioned thin plate magnet.

Preferably, the aforementioned magnetic gap has a gap length of about 500 μm or less, and the aforementioned magnet for magnetic bias has a thickness equivalent to, or less than, the gap length, and is magnetized in the direction of the thickness.

Furthermore, the present embodiment further relates to a low-profile inductor component having an excellent direct current superimposition characteristic and a reduced core loss. In the inductor component, at least one coil having at least one turn is applied to the magnetic core including the aforementioned thin plate magnet as the magnet for magnetic bias.

In the present embodiment, the research was conducted regarding the possibility of use of a thin plate magnet having a thickness of 500 μm or less as the permanent magnet for magnetic bias to be inserted into the magnetic gap of the magnetic core. As a result, superior direct current superimposition characteristic could be achieved when the thin plate magnet for use contained a specified resin at a content of 30% by volume or more, and had a resistivity of 0.1 Ω·cm or more and an intrinsic coercive force iHc of 10 KOe or more, and furthermore, a magnetic core having a core loss characteristic with no occurrence of degradation could be formed. This is based on the finding of the fact that the magnet characteristic necessary for achieving superior direct current superimposition characteristic is an intrinsic coercive force rather than an energy product and, therefore, sufficiently high direct current superimposition characteristic can be achieved as long as the intrinsic coercive force is high, even when a permanent magnet having a low energy product is used.

The magnet having a high resistivity and high intrinsic coercive force can be generally achieved by a rare-earth bonded magnet, and the rare-earth bonded magnet is produced by mixing the rare-earth magnet powder and a binder and by molding the resulting mixture. However, any composition may be used as long as the magnet powder has a high coercive force. The kind of the rare-earth magnet powder may be any of SmCo-base, NdFeB-base, and SmFeN-base. However, in consideration of thermal demagnetization during the use, for example, reflow, the magnet must has a Curie point Tc of 500° C. or more and an intrinsic coercive force iHc of 10 KOe or more.

By coating the magnet powder with a surfactant, dispersion of the powder in a molding becomes excellent and, therefore, the characteristics of the magnet are improved. Consequently, a magnetic core having superior characteristics can be achieved.

Any material having a soft magnetic characteristic may be effective as the material for the magnetic core for a choke coil and transformer, although, in general, MnZn ferrite or NiZn ferrite, dust cores, silicon steel plates, amorphous, etc., are used. The shape of the magnetic core is not specifically limited and, therefore, the present invention can be applied to magnetic cores having any shape, for example, toroidal cores, EE cores, and EI cores. The core includes at least one gap in the magnetic path, and a thin plate magnet is inserted into the gap. The gap length is not specifically limited, although when the gap length is excessively reduced, the direct current superimposition characteristic is degraded, and when the gap length is excessively increased, the magnetic permeability is excessively reduced and, therefore, the gap length to be formed is inevitably determined. In order to reduce the whole core size, the gap length is preferably 500 μm or less.

Regarding the characteristics required of the thin plate magnet to be inserted into the gap, when the intrinsic coercive force is 10 KOe or less, the coercive force disappears due to a direct current magnetic field applied to the magnetic core and, therefore, the coercive force is required to be 10 KOe or more. The greater resistivity is the better. However, the resistivity does not become a primary factor of degradation of the core loss as long as the resistivity is 0.1 Ω·cm or more. When the average maximum particle diameter of the powder becomes 50 μm or more, the core loss characteristic is degraded and, therefore, the maximum average particle diameter of the powder is preferably 50 μm or less. When the minimum particle diameter becomes 2.5 μm or less, the magnetization is reduced remarkably due to oxidation of the magnetic powder during heat treatment of the powder and reflow. Therefore, the particle diameter must be 2.5 μm or more.

Examples according to the third embodiment of the present invention will be described below.

EXAMPLE 5

A $Sm_2Co_{17}$ magnet powder and a polyimide resin were hot-kneaded by using a Labo Plastomill as a hot kneader. The kneading was performed at various resin contents chosen within the range of 15% by volume to 40% by volume. An attempt was made to mold the resulting hot-kneaded material into a thin plate magnet of 0.5 mm by using a hot-pressing machine. As a result, the resin content had to be 30% by volume or more in order to perform the molding. Regarding the present embodiment, the above description is only related to the results on the thin plate magnet containing a polyimide resin. However, results similar to those described above were derived from each of the thin plate magnets containing an epoxy resin, poly (phenylene sulfide) resin, silicone resin, polyester resin, aromatic polyamide, or liquid crystal polymer other than the polyimide resin.

EXAMPLE 6

Each of the magnet powders and each of the resins were hot-kneaded at the compositions shown in the following Table 7 by using a Labo Plastomill. Each of the set temperatures of the Labo Plastomill during operation was specified to be the temperature 5° C. higher than the softening temperature of each of the resins.

TABLE 7

| | composition | iHc (kOe) | mixing ratio (weight part) |
|---|---|---|---|
| ① | $Sm_2Co_{17}$magnet powder | 15 | 100 |
| | polyimide resin | — | 50 |
| ② | $Sm_2Co_{17}$magnet powder | 15 | 100 |
| | epoxy resin | — | 50 |
| ③ | $Sm_2Fe_{17}N$ magnet powder | 10.5 | 100 |
| | polyimide resin | — | 50 |

TABLE 7-continued

| | composition | iHc (kOe) | mixing ratio (weight part) |
|---|---|---|---|
| ④ | Ba Ferrite magnet powder | 4.0 | 100 |
| | polyimide resin | — | 50 |
| ⑤ | $Sm_2Co_{17}$magnet powder | 15 | 100 |
| | ploypropylene resin | — | 50 |

The resulting material hot-kneaded with the Labo Plastomill was die-molded into a thin plate magnet of 0.5 mm by using a hot-pressing machine without magnetic field. This thin plate magnet was cut so as to have the same cross-sectional shape with that of the central magnetic leg of the E type ferrite core 33 shown in FIGS. 1 and 2.

Subsequently, as shown in FIGS. 1 and 2, a central magnetic leg of an EE type core was processed to have a gap of 0.5 mm. The EE type core was made of common MnZn ferrite material and had a magnetic path length of 7.5 cm and an effective cross-sectional area of 0.74 $cm^2$. The thin plate magnet 31 produced as described above was inserted into the gap portion and, therefore, a magnetic core having a magnetic bias magnet 31 was produced. In the drawing, reference numeral 31 denotes the thin plate magnet and reference numeral 33 denotes the ferrite core. The magnet 31 was magnetized in the direction of the magnetic path of the core 33 with a pulse magnetizing apparatus, a coil 35 was applied to the core 33, and an inductance L was measured with a 4284 LCR meter manufactured by Hewlet Packerd under the conditions of an alternating current magnetic field frequency of 100 KHz and a superimposed magnetic field of 0 to 200 Oe. Thereafter, the inductance L was measured again after keeping for 30 minutes at 270° C. in a reflow furnace, and this measurement was repeated five times. At this time, the direct current superimposed current was applied and, therefore, the direction of the magnetic field due to the direct current superimposition was made reverse to the direction of the magnetization of the magnetic bias magnet. The magnetic permeability was calculated from the resulting inductance L, core constants (core size, etc.), and the number of turns of coil and, therefore, the direct current superimposition characteristic was determined. FIGS. 3 to 7 show the direct current superimposition characteristics of each cores based on the five times of measurements.

Figure 7:
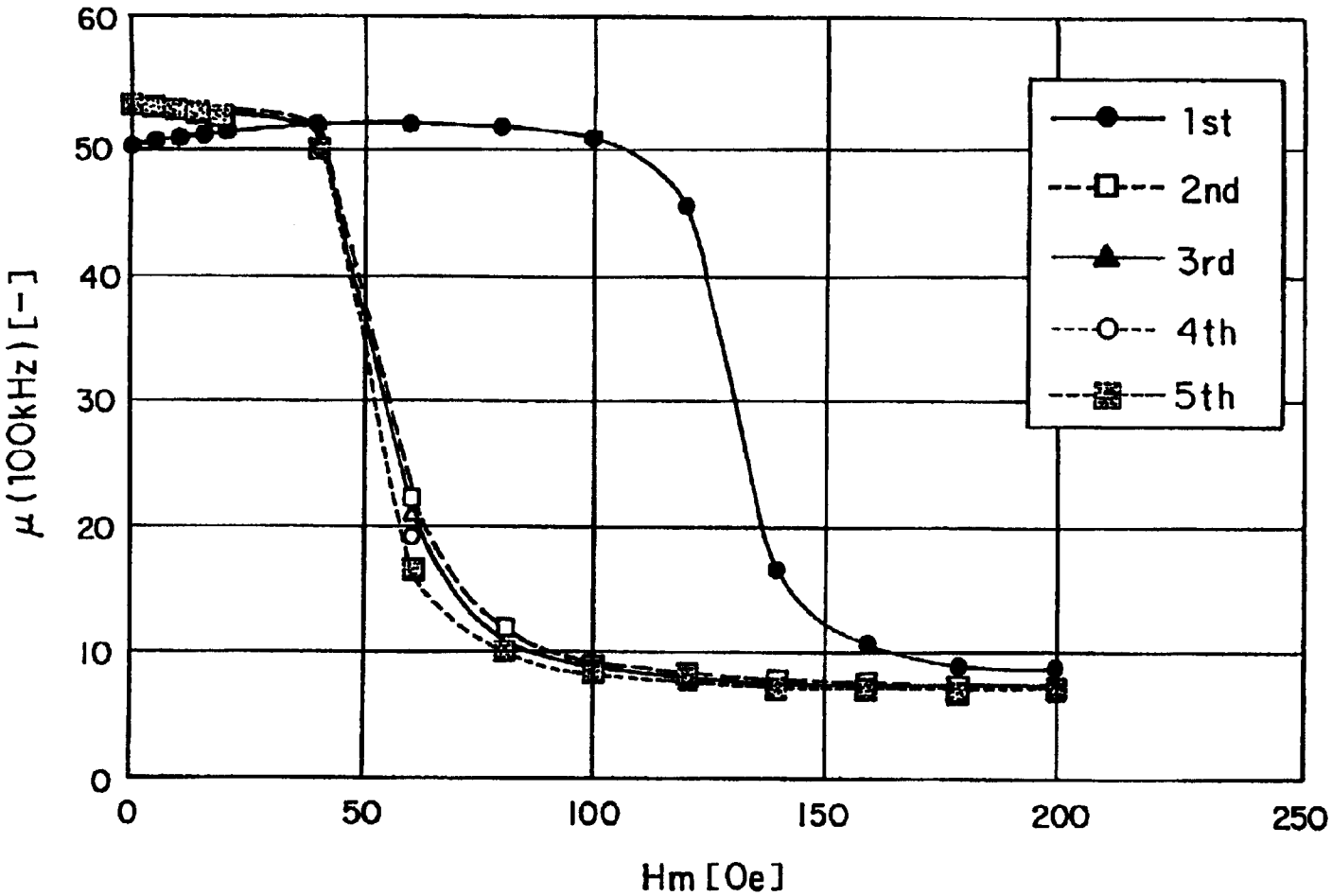
FIG. 7 is a graph showing measurement data of the direct current superimposition characteristic regarding a thin plate magnet composed of a $Sm_2Co_{17}$ magnet and a polypropylene resin in Example 6.

As is clearly shown in FIG. 7, the direct current superimposition characteristic is degraded by a large degree in the second measurement or later regarding the core with the thin plate magnet being inserted and composed of a $Sm_2Co_{17}$ magnet powder dispersed in a polypropylene resin. This degradation is due to deformation of the thin plate magnet during the reflow. As is clearly shown in FIG. 6, the direct current superimposition characteristic is degraded by a large degree with increase in number of measurements regarding the core with the thin plate magnet being inserted, while this thin plate magnet is composed of Ba ferrite having a coercive force of only 4 KOe and dispersed in a polyimide resin. On the contrary, as is clearly shown in FIGS. 3 to 5, large changes are not observed in the repeated measurements and very stable characteristics are exhibited regarding the cores with the thin plate magnets being inserted, while the thin plate magnets use the magnet powder having a coercive force of 10 KOe or more and a polyimide or epoxy resin. From the aforementioned results, the reason for the degradation of the direct current superimposition characteristic can be assumed to be that since the Ba ferrite thin plate magnet has a small coercive force, reduction of magnetization or inversion of magnetization is brought about by a magnetic field in the reverse direction applied to the thin plate magnet. Regarding the thin plate magnet to be inserted into the core, when the thin plate magnet has a coercive force of 10 KOe or more, superior direct current superimposition characteristic is exhibited. Although not shown in the present embodiment, the effects similar to the aforementioned effects were reliably achieved regarding combinations other than that in the present embodiment and regarding thin plate magnets produced by using a resin selected from the group consisting of poly(phenylene sulfide) resins, silicone resins, polyester resins, aromatic polyamides, and liquid crystal polymers.

EXAMPLE 7

Each of the $Sm_2Co_{17}$ magnet powders and 30% by volume of poly(phenylene sulfide) resin were hot-kneaded using a Labo Plastomill. Each of the magnet powders had a particle diameter of 1.0 μm, 2.0 μm, 25 μm, 50 μm, or 55 μm. Each of the resulting materials hot-kneaded with the Labo Plastomill was die-molded into a thin plate magnet of 0.5 mm with a hot-pressing machine without magnetic field. This thin plate magnet 31 was cut so as to have the same cross-sectional shape with that of the central magnetic leg of the E type ferrite core 33 and, therefore, a core as shown in FIGS. 1 and 2 was produced. Subsequently, the thin plate magnet 31 was magnetized in the direction of the magnetic path of the core 33 with a pulse magnetizing apparatus, a coil 35 was applied to the core 33, and a core loss characteristic was measured with a SY-8232 alternating current BH tracer manufactured by Iwatsu Electric Co., Ltd., under the conditions of 300 KHz and 0.1 T at room temperature. The results thereof are shown in Table 8. As is clearly shown in Table 8, superior core loss characteristics were exhibited when the average particle diameters of the magnet powder used for the thin plate magnet were within the range of 2.5 to 50 μm.

TABLE 8

| | | | | | |
|---|---|---|---|---|---|
| particle diameter (μm) | 2.0 | 2.5 | 25 | 50 | 55 |
| core loss ($kW/m^3$) | 670 | 520 | 540 | 555 | 790 |

EXAMPLE 8

Hot-kneading of 60% by volume of $Sm_2Co_{17}$ magnet powder and 40% by volume of polyimide resin was performed by using a Labo Plastomill. Moldings of 0.3 mm were produced from the resulting hot-kneaded materials by a hot-pressing machine while the pressures for pressing were changed. Subsequently, magnetization was performed with a pulse magnetizing apparatus at 4 T and, therefore, thin plate magnets were produced. Each of the resulting thin plate magnets had a glossiness of within the range of 15% to 33%, and the glossiness increased with increase in pressure of the pressing. These moldings were cut into 1 cm×1 cm, and the flux was measured with a TOEI TDF-5 Digital Fluxmeter. The measurement results of the flux and glossiness are shown side by side in Table 9.

TABLE 9

| | | | | | | |
|---|---|---|---|---|---|---|
| glossiness (%) | 15 | 21 | 23 | 26 | 33 | 45 |
| flux (Gauss) | 42 | 51 | 54 | 99 | 101 | 102 |

As shown in Table 9, the thin plate magnets having a glossiness of 25% or more exhibit superior magnetic characteristics. The reason therefor is that the filling factor becomes 90% or more when the produced thin plate magnet has a glossiness of 25% or more. Although only the results of experiments using the polyimide resin are described in the present embodiment, the results similar to the aforementioned results were exhibited regarding one kind of resin selected from the group consisting of epoxy resins, poly (phenylene sulfide) resins, silicone resins, polyester resins, aromatic polyamides, and liquid crystal polymers other than the polyimide resin.

EXAMPLE 9

A $Sm_2Co_{17}$ magnet powder was mixed with RIKACOAT (polyimide resin) manufactured by New Japan Chemical Co., Ltd., and γ-butyrolactone as a solvent, and the resulting mixture was agitated with a centrifugal deaerator for 5 minutes. Subsequently, kneading was performed with a triple roller mill and, therefore, paste was produced. If the paste was dried, the composition became 60% by volume of $Sm_2Co_{17}$ magnet powder and 40% by volume of polyimide resin. The blending ratio of the solvent, γ-butyrolactone, was specified to be 10 parts by weight relative to the total of the $Sm_2Co_{17}$ magnet powder and RIKACOAT manufactured by New Japan Chemical Co., Ltd., of 70 parts by weight. A green sheet of 500 μm was produced from the resulting paste by a doctor blade method, and drying was performed. The dried green sheet was cut into 1 cm×1 cm, and a hot press was performed with a hot-pressing machine while the pressures for pressing were changed. The resulting moldings were magnetized with a pulse magnetizing apparatus at 4 T and, therefore, thin plate magnets were produced. A molding with no hot press was also made to be a thin plate magnet by magnetization for purposes of comparison. At this time, production was performed at the blending ratio, although components and blending ratios other than the above description may be applied as long as a paste capable of making a green sheet can be produced. Furthermore, the triple roller mill was used for kneading, although a homogenizer, sand mill, etc, may be used other than the triple roller mill. Each of the resulting thin plate magnets had a glossiness of within the range of 9% to 28%, and the glossiness increased with increase in pressure of the pressing. The flux of the thin plate magnet was measured with a TOEI TDF-5 Digital Fluxmeter and the measurement results are shown in Table 10. Table 10 also shows side by side the results of the measurement of compressibility in hot press (=1−thickness after hot press/thickness before hot press) of the thin plate magnet at this time.

TABLE 10

| | | | | | | |
|---|---|---|---|---|---|---|
| glossiness (%) | 9 | 13 | 18 | 22 | 25 | 28 |
| flux (Gauss) | 34 | 47 | 51 | 55 | 100 | 102 |
| compressibility (%) | 0 | 6 | 11 | 14 | 20 | 21 |

As is clear from the results, similarly to Example 8, excellent magnetic characteristics can be exhibited when the glossiness is 25% or more. The reason therefor is also that the filling factor of the thin plate magnet becomes 90% or more when the glossiness is 25% or more. Regarding the compressibility, the aforementioned results show that excellent magnetic characteristics can be exhibited when the compressibility is 20% or more.

Although the above description is related to the results of experiments using the polyimide resin at specified compositions and blending ratios in the present embodiment, the results similar to the aforementioned results were exhibited regarding one kind of resin selected from the group consisting of epoxy resins, poly(phenylene sulfide) resins, silicone resins, polyester resins, aromatic polyamides, and liquid crystal polymers, and blending ratios other than those in the above description.

EXAMPLE 10

A $Sm_2Co_{17}$ magnet powder was mixed with 0.5% by weight of sodium phosphate as a surfactant. Likewise, a $Sm_2Co_{17}$ magnet powder was mixed with 0.5% by weight of sodium carboxymethylcellulose, and a $Sm_2Co_{17}$ magnet powder was mixed with sodium silicate. 65% by volume of each of these mixed powder and 35% by volume of poly (phenylene sulfide) resin were hot-kneaded by using a Labo Plastomill. Each of the resulting materials hot-kneaded with the Labo Plastomill was molded into 0.5 mm by hot press and, therefore, a thin plate magnet was produced. The resulting thin plate magnet was cut so as to have the same cross-sectional shape with that of the central magnetic leg of the same E type ferrite core 33 with that in Example 6 shown in FIGS. 1 and 2. The thin plate magnet 31 produced as described above was inserted into the central magnetic leg gap portion of the EE core 33 and, therefore, a core shown in FIGS. 1 and 2 was produced. Subsequently, the thin plate magnet 31 was magnetized in the direction of the magnetic path of the core 33 with a pulse magnetizing apparatus, a coil 35 was applied to the core 33, and a core loss characteristic was measured with a SY-8232 alternating current BH tracer manufactured by lwatsu Electric Co., Ltd., under the conditions of 300 KHz and 0.1 T at room temperature. The measurement results thereof are shown in Table 11. For purposes of comparison, the surfactant was not used, and 65% by volume of $Sm_2Co_{17}$ magnet powder and 35% by volume of poly(phenylene sulfide) resin were kneaded with the Labo Plastomill. The resulting hot-kneaded material was molded into 0.5 mm by hot press, and the resulting molding was inserted into the magnetic gap of the central magnetic leg of the same EE ferrite core with that in the above description. Subsequently, this was magnetized in the direction of the magnetic path of the core with a pulse magnetizing apparatus, a coil was applied, and a core loss was measured. The results thereof are also shown side by side in Table 11.

As shown in Table 11, excellent core loss characteristics are exhibited when the surfactant is added. The reason therefor is that coagulation of primary particles is prevented and the eddy current loss is alleviated by the

TABLE 11

| sample | core loss ($kW/m^3$) |
|---|---|
| +sodium phosphate | 495 |
| +sodium carboxyllmethylcellulose | 500 |
| +sodium silicate | 485 |
| no additive | 590 |

addition of the surfactant. Although the above description is related to the results of addition of the phosphate in the present embodiment, similarly to the aforementioned results, excellent core loss characteristics were exhibited when surfactants other than that in the above description were added.

EXAMPLE 11

Each of $Sm_2Co_{17}$ magnet powders and a polyimide resin were hot-kneaded with a Labo Plastomill. The resulting mixture was press-molded into a thin plate magnet of 0.5 mm in thickness with a hot-pressing machine without magnetic field. Herein, each of thin plate magnets having a resistivity of 0.05, 0.1, 0.2, 0.5, or 1.0 Ω·cm was produced by controlling the content of the polyimide resin. Thereafter, this thin plate magnet was processed so as to have the same cross-sectional shape with that of the central magnetic leg of the E type ferrite core 33 shown in FIGS. 1 and 2, in a manner similar to that in Example 6. Subsequently, the thin plate magnet 31 produced as described above was inserted into the magnetic gap of the central magnetic leg of the EE type core 33 made of MnZn ferrite material and having a magnetic path length of 7.5 cm and an effective cross-sectional area of 0.74 $cm^2$. The magnetization in the direction of the magnetic path was performed with an electromagnet, a coil 35 was applied, and a core loss characteristic was measured with a SY-8232 alternating current BH tracer manufactured by lwatsu Electric Co., Ltd., under the conditions of 300 KHz and 0.1 T at room temperature. Herein, the same ferrite core was used in the measurements, and the core losses were measured while only the magnet was changed to other magnet having a different resistivity. The results thereof are shown in Table 12.

TABLE 12

| resisitivity (Ω.cm) | 0.05 | 0.1 | 0.2 | 0.5 | 1.0 |
|---|---|---|---|---|---|
| core loss ($kW/m^3$) | 1220 | 530 | 520 | 515 | 530 |

As is clearly shown in Table 12, excellent core loss characteristics are exhibited when the magnetic cores have a resistivity of 0.1 Ω·cm or more. The reason therefor is that the eddy current loss can be alleviated by increasing the resistivity of the thin plate magnet.

EXAMPLE 12

Each of the various magnet powders and each of the various resins were kneaded at the compositions shown in Table 13, molded, and processed by the method as described below and, therefore, samples of 0.5 mm in thickness were produced. Herein, a $Sm_2Co_{17}$ powder and a ferrite powder were pulverized powders of sintered materials. A $Sm_2Fe_{17}N$ powder was a powder prepared by subjecting the $Sm_2Fe_{17}$ powder produced by a reduction and diffusion method to a nitriding treatment. Each of the powders had an average particle diameter of about 5 μm. Each of an aromatic polyamide resin (6T-nylon) and a polypropylene resin was hot-kneaded by using a Labo Plastomill in Ar at 300° C. (polyamide) and 250° C. (polypropylene), respectively, and was molded with a hot-pressing machine so as to produce a sample. A soluble polyimide resin was mixed with γ-butyrolactone as a solvent and the resulting mixture was agitated with a centrifugal deaerator for 5 minutes so as to produce a paste. Subsequently, a green sheet of 500 μm when completed was produced by a doctor blade method, and was dried and hot-pressed so as to produce a sample. An epoxy resin was agitated and mixed in a beaker, and was die-molded. Thereafter, a sample was produced at appropriate curing conditions. All these samples had a resistivity of 0.1 Ω·cm or more.

This thin plate magnet was cut into the cross-sectional shape of the central leg of the ferrite core described below. The core was a common EE core made of MnZn ferrite material and having a magnetic path length of 5.9 cm and an effective cross-sectional area of 0.74 $cm^2$, and the central leg was processed to have a gap of 0.5 mm. The thin plate magnet produced as described above was inserted into the gap portion, and these were arranged as shown in FIGS. 1 and 2 (reference numeral 31 denotes a thin plate magnet, reference numeral 33 denotes a ferrite core, and reference numeral 35 denotes coiled portions).

Subsequently, magnetization was performed in the direction of the magnetic path with a pulse magnetizing apparatus, and thereafter, regarding the direct current superimposition characteristic, an effective permeability was measured with a HP-4284A LCR meter manufactured by Hewlet Packerd under the conditions of an alternating current magnetic field frequency of 100 KHz and a direct current superimposed magnetic field of 35 Oe.

These cores were kept for 30 minutes in a reflow furnace at 270° C., and thereafter, the direct current superimposition characteristic was measured again under the same conditions.

As a comparative example, the measurement was carried out on a magnetic core with no magnet being inserted into the gap with the result that the characteristic did not changed between before and after the reflow, and the effective permeability $\mu e$ was 70.

Figure 8:
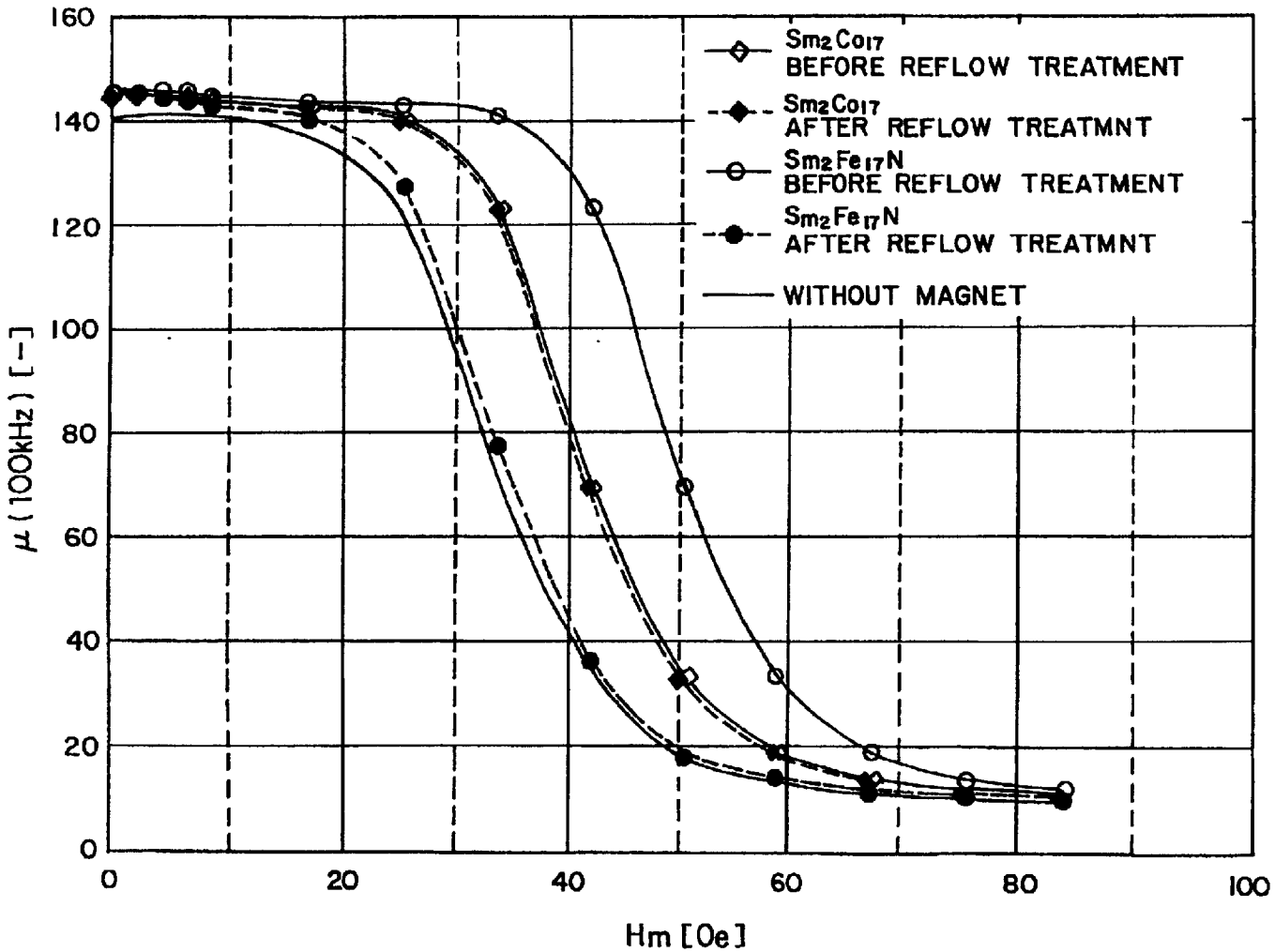
FIG. 8 is a graph showing measurement data of the direct current superimposition characteristic before and after the reflow, in the case where a thin plate magnet made of Sample 2 or 4 is used and in the case where no thin plate magnet is used, in Example 12.

Table 13 shows these results, and FIG. 8 shows direct current superimposition characteristics of Samples 2 and 4 and Comparative example as a part of the results. As a matter of course, superimposed direct current was applied in order that the direction of the direct current bias magnetic field was made reverse to the direction of the magnetization of the magnet magnetized at the time of insertion.

Regarding the core with a thin plate magnet of polypropylene resin being inserted, the measurement could not be carried out due to remarkable deformation of the magnet.

Regarding the core with the Ba ferrite thin plate magnet having a coercive force of only 4 KOe being inserted, the direct current superimposition characteristic is degraded by a large degree after the reflow. Regarding the core with the $Sm_2Fe_{17}N$ thin plate magnet being inserted, the direct current superimposition characteristic is also degraded by a large degree after the reflow. On the contrary, regarding the core with the $Sm_2Co_{17}$ thin plate magnet having a coercive force of 10 KOe or more and a Tc of as high as 770° C. being inserted, degradation of the characteristics are not observed and, therefore, very stable characteristics are exhibited.

From these results, the reason for the degradation of the direct current superimposition characteristic is assumed to be that since the Ba ferrite thin plate magnet has a mall coercive force, reduction of magnetization or inversion of magnetization is brought about by a magnetic field in the reverse direction applied to the thin plate magnet. The reason for the degradation of the characteristics is assumed to be that although the SmFeN magnet has a high coercive force, the Tc is as low as 470° C. and, therefore, thermal demagnetization occurs, and the synergetic effect of the thermal demagnetization and the demagnetization caused by a magnetic field in the reverse direction is brought about. Therefore, regarding the thin plate magnet inserted into the core, superior direct current superimposition characteristics are exhibited when the thin plate magnet has a coercive force of 10 KOe or more and a Tc of 500° C. or more.

Although not shown in the present embodiment, the effects similar to those described above could be reliably achieved when the combinations were other than those in the present embodiment, and when thin plate magnets for use were produced from other resins within the scope of the present invention.

TABLE 13

| sample | magnet composition<br>resin composition | iHc (kOe) | mixing ratio (weight part) | $\mu e$ before reflow (at 35 Oe) | $\mu e$ after reflow (at 35 Oe) |
|---|---|---|---|---|---|
| ① | Sm $(Co_{0.742}Fe_{0.20}Cu_{0.055}Zr_{0.029})_{7.7}$ | 15 | 100 | 140 | 130 |
| | aromatic polyamide resin | — | 100 | | |
| ② | $Sm(Co_{0.742}Fe_{0.20}Cu_{0.055}Zr_{0.029})_{7.7}$ | 15 | 100 | 120 | 120 |
| | soluble polyimide resin | — | 100 | | |
| ③ | $Sm(Co_{0.742}Fe_{0.20}Cu_{0.055}Zr_{0.029})_{7.7}$ | 15 | 100 | 140 | 120 |
| | epoxy resin | — | 100 | | |
| ④ | $Sm_2Fe_{17}N$ magnetic powder | 10 | 100 | 140 | 70 |
| | aromatic polyamide resin | — | 100 | | |
| ⑤ | Ba ferrite magnet powder | 4.0 | 100 | 90 | 70 |
| | aromatic polyamide resin | — | 100 | | |
| ⑥ | $Sm(Co_{0.742}Fe_{0.20}Cu_{0.055}Zr_{0.029})_{7.7}$ | 15 | 100 | 140 | — |
| | polypropylene resin | — | 100 | | |

EXAMPLE 13

Kneading was performed regarding the same $Sm_2Co_{17}$ magnetic powder (iHc=15 KOe) with that in Example 12 and a soluble poly(amide-imide) resin (TOYOBO VIROMAX) by using a pressure kneader. The resulting mixture was diluted and kneaded with a planetary mixer, and was agitated with a centrifugal deaerator for 5 minutes so as to produce a paste. Subsequently, a green sheet of about 500 $\mu$m in thickness when dried was produced from the resulting paste by a doctor blade method, and was dried, hot-pressed, and processed to have a thickness of 0.5 mm and, therefore, a thin plate magnet sample was produced. Herein, the content of the poly(amide-imide) resin was adjusted as shown in Table 14 in order that the thin plate magnets had the resistivity of 0.06, 0.1, 0.2, 0.5, and 1.0 Ω·cm. Thereafter, these thin plate magnets were cut into the cross-sectional shape of the central leg of the same core with that in Example 5 so as to prepare samples.

Subsequently, each of the thin plate magnets produced as described above was inserted into the gap having a gap length of 0.5 mm of the same EE type core with that in Example 12, and the magnet was magnetized with a pulse magnetizing apparatus. Regarding the resulting core, a core loss characteristic was measured with a SY-8232 alternating current BH tracer manufactured by Iwatsu Electric Co., LTd., under the conditions of 300 KHz and 0.1 T at room temperature. Herein, the same ferrite core was used in the measurements, and the core loss was measured after only the magnet was charged to other magnet having a different resistivity, and was inserted and magnetized again with the pulse magnetizing apparatus.

The results thereof are shown in Table 4. An EE core with the same gap had a core loss characteristic of 520 (kW/m$^3$) under the same measuring conditions, as a comparative example.

As shown in Table 14, magnetic cores having a resistivity of 0.1 Ω·cm or more exhibit excellent core loss characteristics. The reason therefor is assumed to be that the eddy current loss can be alleviated by increasing the resistivity of the thin plate magnetic.

TABLE 14

| sample | magnet composition | amount of resin (vol %) | resistivity (Ω. cm) | core loss (kW/m$^3$) |
|---|---|---|---|---|
| 1 | $Sm(Co_{0.742}Fe_{0.20}Cu_{0.055}Zr_{0.029})_{7.7}$ | 25 | 0.06 | 1250 |
| 2 | | 30 | 0.1 | 680 |
| 3 | | 35 | 0.2 | 600 |
| 4 | | 40 | 0.5 | 530 |
| 5 | | 50 | 1.0 | 540 |

EXAMPLE 14

Magnet powders having different average particle diameters were prepared from a sintered magnet (iHc=15 KOe) having a composition $Sm(Co_{0.742}Fe_{0.20}Cu_{0.055}Zr_{0.029})_{7.7}$ by changing pulverization times, and thereafter maximum particle diameters were adjusted through sieves having different meshes.

A $Sm_2Co_{17}$ magnet powder was mixed with RIKACOAT (polyimide resin) manufactured by New Japan Chemical Co., Ltd., and γ-butyrolactone as a solvent, the resulting mixture was agitated with a centrifugal deaerator for 5 minutes and, therefore, paste was produced. If the paste was dried, the composition became 60% by volume of $Sm_2Co_{17}$ magnet powder and 40% by volume of polyimide resin. The blending ratio of the solvent, γ-butyrolactone, was specified to be 10 parts by weight relative to the total of the $Sm_2Co_{17}$ magnet powder and RIKACOAT manufactured by New Japan Chemical Co., Ltd., of 70 parts by weight. A green sheet of 500 μm was produced from the resulting paste by a doctor blade method, and drying and hot press were performed. The resulting sheet was cut into the shape of the central leg of the ferrite core, and was magnetized with a pulse magnetizing apparatus at 4 T and, therefore, a thin plate magnet were produced. The flux of each of these thin plate magnets was measured with a TOEI TDF-5 Digital Fluxmeter, and the measurement results are shown in Table 15. Furthermore, the thin plate

TABLE 15

| sample | average particle diameter (μm) | mesh of sieve (μm) | press pressure upon hot press (kgf/cm$^2$) | center line average roughness (μm) | amount of flux (G) | bias amount (G) |
|---|---|---|---|---|---|---|
| 1 | 2.1 | 45 | 200 | 1.7 | 30 | 600 |
| 2 | 2.5 | 45 | 200 | 2 | 130 | 2500 |
| 3 | 5.4 | 45 | 200 | 6 | 110 | 2150 |
| 4 | 25 | 45 | 200 | 20 | 90 | 1200 |
| 5 | 5.2 | 45 | 100 | 12 | 60 | 1100 |
| 6 | 5.5 | 90 | 200 | 15 | 100 | 1400 |

magnet was inserted into the ferrite core in a manner similar to that in Example 12, and direct current superimposition characteristic was measured. Subsequently, the quantity of bias was measured. The quantity of bias was determined as a product of magnetic permeability and superimposed magnetic field.

Regarding Sample 1 having an average particle diameter of 2.1 μm, the flux is reduced and the quantity of bias is small. The reason therefor is believed to be that oxidation of the magnet powder proceeds during production steps. Regarding Sample 4 having a large average particle diameter, the flux is reduced due to a low filling factor of the powder, and the quantity of bias is reduced. The reason for the reduction of the quantity of bias is believed to be that since the surface roughness of the magnet is coarse, adhesion with the core is insufficient and, therefore, permeance coefficient is reduced. Regarding Sample 5 having a small particle diameter, but having a large surface roughness due to an insufficient pressure during the press, the flux is reduced due to a low filling factor of the powder, and the quantity of bias is reduced. Regarding Sample 6 containing coarse particles, the quantity of bias is reduced. The reason for this is believed to be that the surface roughness is coarse.

As is clear from these results, superior direct current superimposition characteristics are exhibited when an inserted thin plate magnet has an average particle diameter of the magnet powder of 2.5 μm or more, the maximum particle diameter of 50 μm or less, and a center line average roughness of 10 μm or less.

EXAMPLE 15

Two magnet powders were used, and each of the magnet powders was produced by rough pulverization of an ingot and subsequent heat treatment. One ingot was a $Sm_2Co_{17}$-based ingot having a Zr content of 0.01 atomic percent and having a composition of so-called second-generation $Sm_2Co_{17}$ magnet, $Sm(Co_{0.78}Fe_{0.11}Cu_{0.10}Zr_{0.01})_{8.2}$, and the other ingot was a $Sm_2Co_{17}$-based ingot having a Zr content of 0.029 atomic percent and having a composition of so-called third-generation $Sm_2Co_{17}$ magnet, $Sm(Co_{0.0742}Fe_{0.20}Cu_{0.055}Zr_{0.029})_{8.2}$. The second-generation $Sm_2Co_{17}$ magnet powder was subjected to an age heat treatment at 800° C. for 1.5 hours, and the third-generation $Sm_2Co_{17}$ magnet powder was subjected to an age heat treatment at 800° C. for 10 hours. By these treatments, coercive forces measured by VSM were 8 KOe and 20 KOe regarding the second-generation $Sm_2Co_{17}$ magnet powder and the third-generation $Sm_2Co_{17}$ magnet powder, respectively. These roughly pulverized powders were finely pulverized in an organic solvent with a ball mill in order to have an average particle diameter of 5.2 μm, and the resulting powders were passed through a sieve having openings of 45 μm and, therefore, magnet powders were produced. Each of the resulting magnet powders was mixed with 35% by volume of epoxy resin as a binder, and the resulting mixture was die-molded into a bonded magnet having a shape of the central leg of the same EE core with that in Example 12 and a thickness of 0.5 mm. The magnet characteristics were measured using a separately prepared test piece having a diameter of 10 mm and a thickness of 10 mm with a direct current BH tracer.

The coercive forces were nearly equivalent to those of the roughly pulverized powder. Subsequently, these magnets were inserted into the same EE core with that in Example 12, and pulse magnetization and application of coil were performed. Then, the effective permeability was measured with a LCR meter under the conditions of a direct current superimposed magnetic field of 40 Oe and 100 kHz. These cores were kept under the same conditions with those in the reflow, that is, these cores were kept in a thermostatic chamber at 270° C. for 1 hour, and thereafter, the direct current superimposition characteristics were measured in a manner similar to that in the above description. The results thereof are also shown in Table 16.

TABLE 16

| sample | μe before reflow (at 40 Oe) | μe after reflow (at 40 Oe) |
|---|---|---|
| $Sm(Co_{0.78}Fe_{0.11}Cu_{0.10}Zr_{0.01})_{8.2}$ | 120 | 40 |
| $Sm(Co_{0.742}Fe_{0.20}Cu_{0.055}Zr_{0.029})_{8.2}$ | 130 | 130 |

As is clear from Table 16, when the third-generation $Sm_2Co_{17}$ magnet powder having a high coercive force is used, excellent direct current superimposition characteristics can also be achieved even after the reflow. The presence of a peak of the coercive force is generally observed at a specific ratio of Sm and transition metals, although this optimum compositional ratio varies depending on the oxygen content in the alloy as is generally known. Regarding the sintered material, the optimum compositional ratio is verified to vary within 7.0 to 8.0, and regarding the ingot, the optimum compositional ratio is verified to vary within 8.0 to 8.5. As is clear from the above description, excellent direct current superimposition characteristics are exhibited even under reflow conditions when the composition is the third-generation $Sm(Co_{bal}Fe_{0.15\ to\ 0.25}Cu_{0.05\ to\ 0.06}Zr_{0.02\ to\ 0.03})_{7.0\ to\ 8.5}$.

EXAMPLE 16

The magnet powder produced in Sample 3 of Example 14 was used. This magnet powder had a composition $Sm(Co_{0.742}Fe_{0.20}Cu_{0.055}Zr_{0.029})_{7.7}$, an average particle diameter of 5 μm, and a maximum particle diameter of 45 μm. The surface of each of the magnet powders was coated with Zn, inorganic glass ($ZnO—B_2O_3—PbO$) having a softening point of 400° C., or Zn and furthermore inorganic glass ($ZnO—B_2O_3—PbO$). The thin plate magnet was produced in the same manner with that of Sample 2 of Example 13, the resulting thin plate magnet was inserted into the Mn—Zn ferrite core, and the direct current superimposition characteristic of the resulting Mn—Zn ferrite core was measured in a manner exactly similar to that in Example 12. Thereafter the quantity of bias was determined and the core loss characteristic was measured in a manner exactly similar to that in Example 13. The results of the comparison are shown in Table 17.

Herein, Zn was mixed with the magnet powder, and thereafter, a heat treatment was performed at 500° C. in an Ar atmosphere for 2 hours. $ZnO—B_2O_3—PbO$ was heat-treated in the same manner with that of Zn except that the heat treatment temperature was 450° C. On the other hand, in order to form a composite layer, Zn and the magnet powder were mixed and were heat-treated at 500° C., the resulting powder was taken out of the furnace, and the powder and the $ZnO—B_2O_3—PbO$ powder were mixed, and thereafter, the resulting mixture was heat-treated at 450° C. The resulting powder was mixed with a binder (epoxy resin) in an amount of 45% by volume of the total volume, and thereafter, die-molding was performed without magnetic field. The resulting molding had the shape of the cross-section of the central leg of the same ferrite core with that in Example 12 and had a height of 0.5 mm. The resulting molding was inserted into the core, and magnetization was performed with a pulse magnetic field of about 10 T. The direct current superimposition characteristic was measured in the same manner with that in Example 12, and the core loss characteristic was measured in the same manner with that in Example 13. Then, these cores were kept in a thermostatic chamber at 270° C. for 30 minutes, and thereafter, the direct current superimposition characteristic and core loss characteristic were measured similarly to the above description. As a comparative example, a molding was produced from the powder with no coating in the same manner with that described above, and characteristics were measured. The results are also shown in Table 17.

As is clear from the results, although regarding the uncoated sample, the direct current superimposition characteristic and core loss characteristic are degraded by a large degree due to the heat treatment, regarding the samples coated with Zn, inorganic glass, and a composite thereof, rate of the degradation during the heat treatment is very small compared to that of the uncoated sample. The reason therefor is assumed to be that oxidation of the magnet powder is prevented by the coating.

Regarding the samples containing more than 10% by weight of coating materials, the effective permeability is low, and the strength of the bias magnetic field due to the magnet is reduced by a large degree compared to those of other samples. The reason therefor is believed to be that the content of the magnet powder is reduced due to increase in amount of the coating material, or magnetization is reduced due to reaction of the magnet powder and the coating materials. Therefore, especially superior characteristics are exhibited when the amount of the coating material is within the range of 0.1 to 10% by weight.

TABLE 17

| | coating layer | | | before reflow | | after reflow | |
|---|---|---|---|---|---|---|---|
| sample | Zn (vol %) | $B_2O_3$—PbO (vol %) | Zn + $B_2O_3$—PbO (vol %) | bias amount (G) | core loss (kW/m³) | bias amount (G) | core loss (kW/m³) |
| Comparative | — | — | — | 2200 | 520 | 300 | 1020 |
| 1 | 0.1 | | | 2180 | 530 | 2010 | 620 |
| 2 | 1.0 | | | 2150 | 550 | 2050 | 600 |
| 3 | 3.0 | | | 2130 | 570 | 2100 | 580 |
| 4 | 5.0 | | | 2100 | 590 | 2080 | 610 |
| 5 | 10.0 | | | 2000 | 650 | 1980 | 690 |
| 6 | 15.0 | | | 1480 | 1310 | 1480 | 1350 |
| 7 | | 0.1 | | 2150 | 540 | 1980 | 610 |
| 8 | | 1.0 | | 2080 | 530 | 1990 | 590 |
| 9 | | 3.0 | | 2050 | 550 | 2020 | 540 |
| 10 | | 5.0 | | 2020 | 570 | 2000 | 550 |
| 11 | | 10.0 | | 1900 | 560 | 1880 | 570 |
| 12 | | 15.0 | | 1250 | 530 | 1180 | 540 |
| 13 | | | 3 + 2 | 2050 | 560 | 2030 | 550 |
| 14 | | | 5 + 5 | 2080 | 550 | 2050 | 560 |
| 15 | | | 10 + 5 | 1330 | 570 | 1280 | 580 |

EXAMPLE 17

The $Sm_2Co_{17}$ magnet powder of Sample 3 in Example 14 was mixed with 50% by volume of epoxy resin as a binder, and the resulting mixture was die-molded in the direction of top and bottom of the central leg in a magnetic field of 2 T so as to produce an anisotropic magnet. As a comparative example, a magnet was also produced by die-molding without magnetic field. Thereafter, each of these bonded magnets was inserted into a MnZn ferrite material in a manner similar to that in Example 12, and pulse magnetization and application of coil were performed. Then, the direct current superimposition characteristic was measured with a LCR meter, and the magnetic permeability was calculated from the core constants and the number of turns of coil. The results thereof are shown in Table 18.

After the measurements were completed, the samples were kept under the same conditions with those in the reflow, that is, the samples were kept in a thermostatic chamber at 270° C. for 1 hour. Thereafter, the samples were cooled to ambient temperature, and the direct current superimposition characteristics were measured in a manner similar to that in the above description. The results thereof are also shown in Table 18.

As is clearly shown in Table 18, excellent results are exhibited both before and after the reflow compared to that of magnets molded without magnetic field.

TABLE 18

| sample | $\mu e$ before reflow (at 45 Oe) | $\mu e$ before reflow (at 45 Oe) |
|---|---|---|
| molded within magnetic field | 130 | 130 |
| molded without magnetic field | 50 | 50 |

EXAMPLE 18

The $Sm_2Co_{17}$ magnet powder of Sample 3 in Example 14 was mixed with 50% by volume of epoxy resin as a binder, and the resulting mixture was die-molded without magnetic field so as to produce a magnet having a thickness of 0.5 mm in the similar manner described in Example 17. The resulting magnet was inserted into a MnZn ferrite material, and magnetization was performed in a manner similar to that in Example 12. At that time, the magnetic fields for magnetization were 1, 2, 2.5, 3, 5, and 10 T. Regarding 1, 2, and 2.5 T, magnetization was performed with an electromagnet, and regarding 3, 5, and 10 T. magnetization was performed with a pulse magnetizing apparatus. Subsequently, the direct current superimposition characteristic was measured with a LCR meter, and the magnetic permeability was calculated from the core constants and the number of turns of coil. From these results, the quantity of bias was determined by the method used in Example 14, and the results thereof are shown in FIG. 9.

Figure 9:
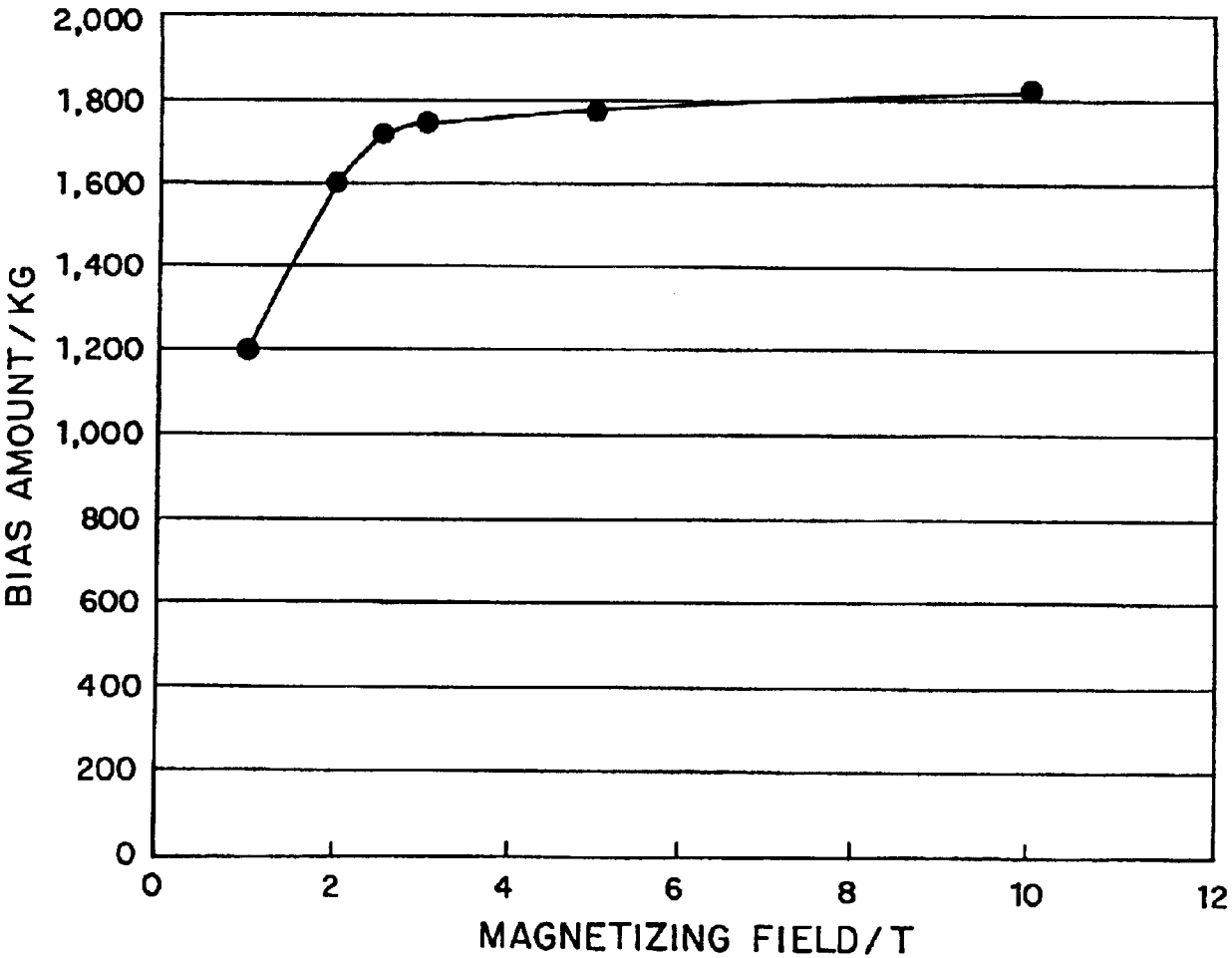
FIG. 9 is a graph showing magnetizing magnetic fields and the direct current superimposition characteristics of a $Sm_2Co_{17}$ magnet-epoxy resin thin plate magnet in Example 18.

As is clearly shown in FIG. 9, excellent superimposition characteristics can be achieved when the magnetic field is 2.5 T or more.

EXAMPLE 19

Figure 10:
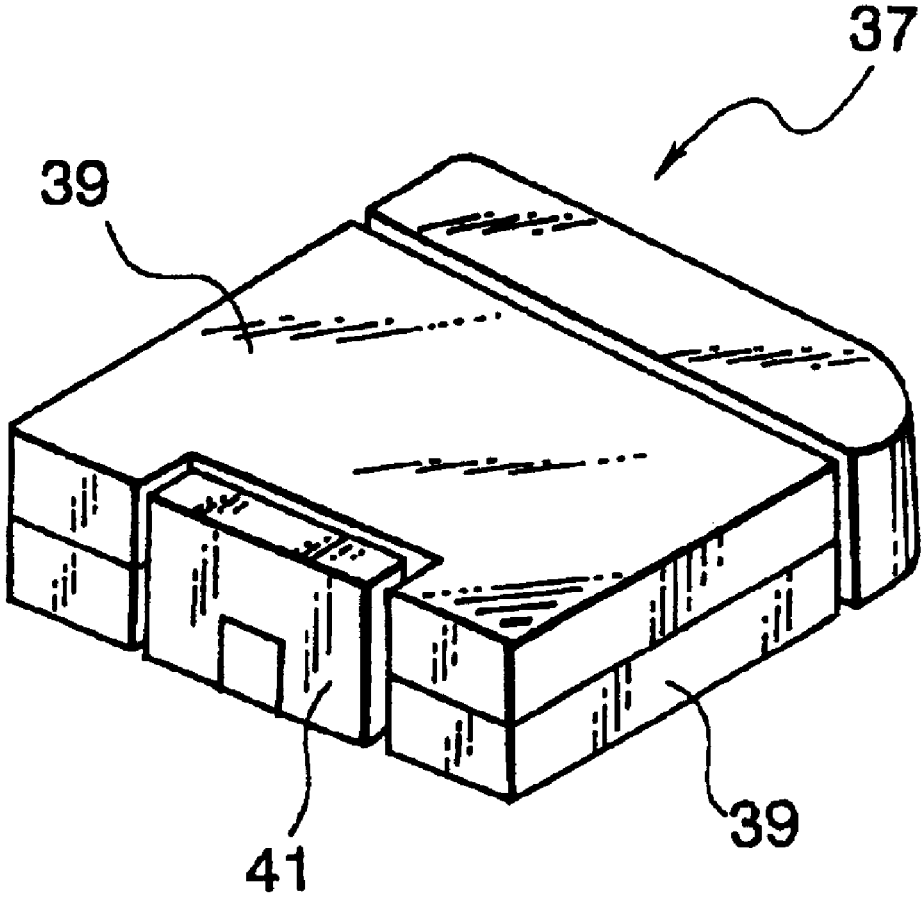
FIG. 10 is a perspective external view of an inductor component including a thin plate magnet according to Example 19 of the present invention.
Figure 11:
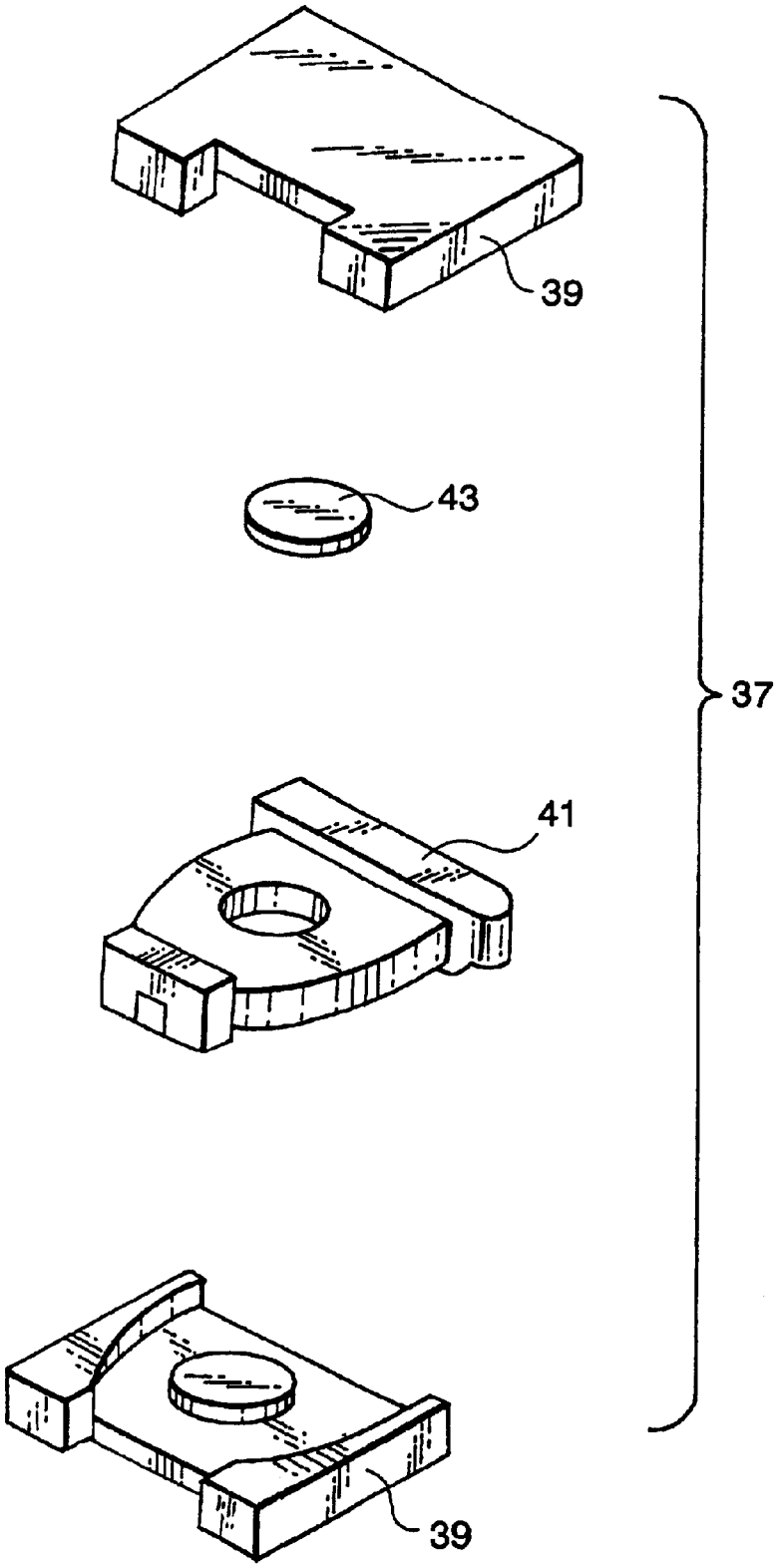
FIG. 11 is a perspective exploded view of the inductor component shown in FIG. 10.

An inductor component according to the present embodiment including a thin plate magnet will now be described below with reference to FIGS. 10 and 11. A core 39 used in the inductor component is made of a MnZn ferrite material and constitutes an EE type magnetic core having a magnetic path length of 2.46 cm and an effective cross-sectional area of 0.394 $cm^2$. The thin plate magnet 43 having a thickness of 0.16 mm is processed into the same shape with the cross-section of the central leg of the E type core 39. As shown in FIG. 11, a molded coil (resin-sealed coil (number of turns of 4 turns)) 41 is incorporated in the E type core 39, the thin plate magnet 43 is arranged in a core gap portion, and is held by the other core 39 and, therefore, this assembly functions as an inductor component.

The direction of the magnetization of the thin plate magnet 43 is specified to be reverse to the direction of the magnetic field made by the molded coil.

Figure 12:
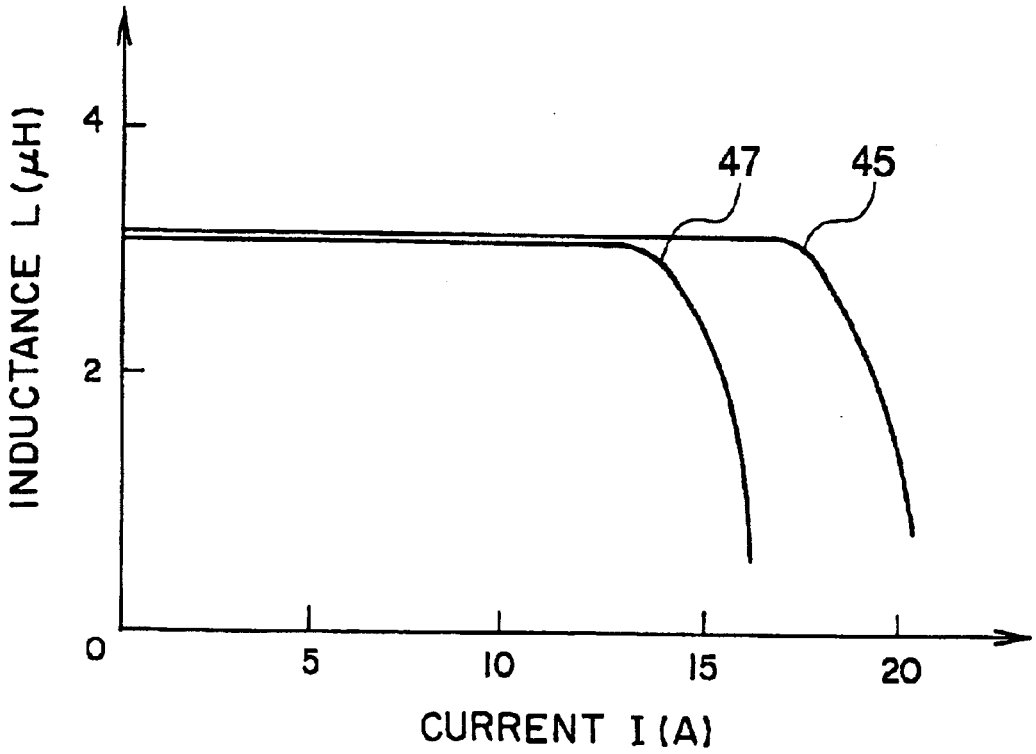
FIG. 12 is a graph showing measurement data of the direct current superimposed inductance characteristic, in the case where a thin plate magnet is applied and in the case where no thin plate magnet is applied for purposes of comparison, in Example 19.

The direct current superimposed inductance characteristics were measured regarding the case where the thin plate magnet was applied and the case where the thin plate magnet was not applied for purposes of comparison, and the results are indicated by 45 (the former) and 47 (the latter) in FIG. 12.

The direct current superimposed inductance characteristic was measured similarly to the above description after passing through a reflow furnace, in which peak temperature is 270° C. As a result, the direct current superimposed inductance characteristic after the reflow was verified to be equivalent to that before the reflow.

EXAMPLE 20

Figure 13:
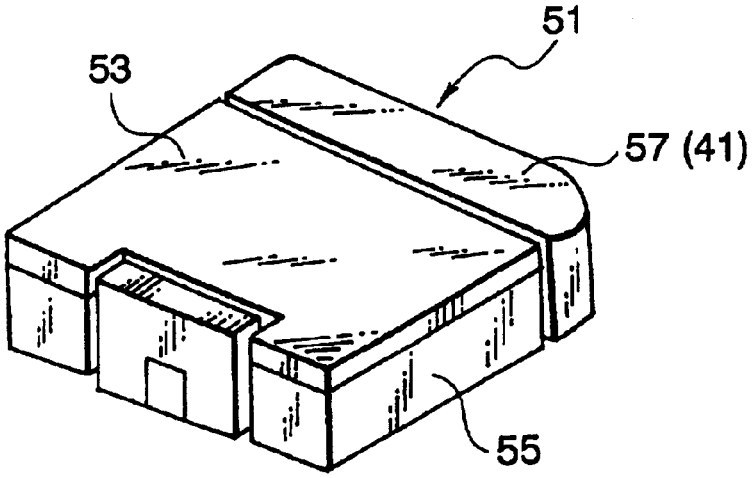
FIG. 13 is a perspective external view of an inductor component including a thin plate magnet according to Example 20 of the present invention.
Figure 14:
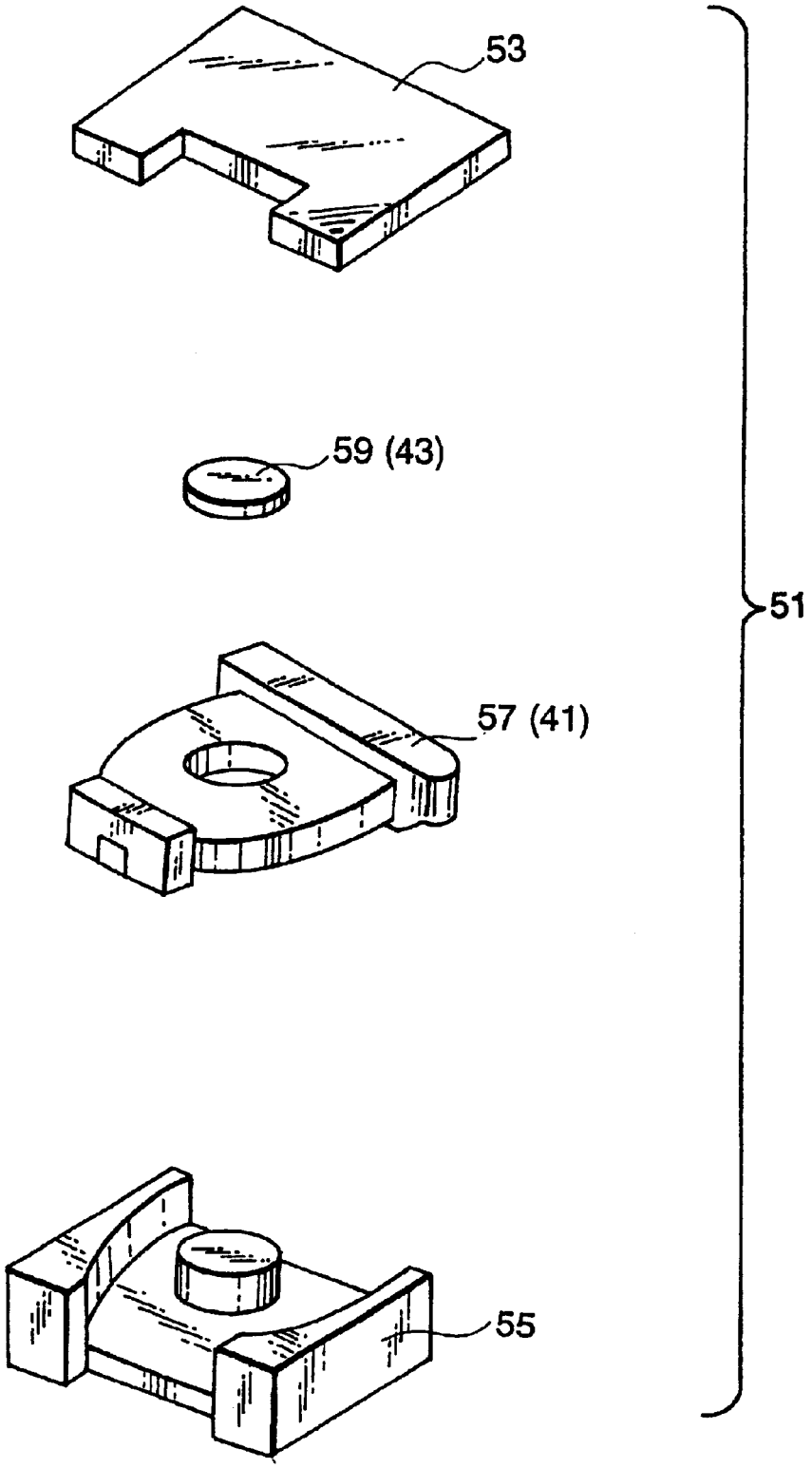
FIG. 14 is a perspective exploded view of the inductor component shown in FIG. 13.

Another inductor component according to the present embodiment will now be described below with reference to FIGS. 13 and 14. A core used in the inductor component is made of a MnZn ferrite material and constitutes a magnetic core having a magnetic path length of 2.46 cm and an effective cross-sectional area of 0.394 $cm^2$ in a manner similar to that in Example 19. However, an EI type magnetic core is formed and functions as an inductor component. The steps for assembling are similar to those in Example 19, although the shape of one ferrite core 53 is I type.

The direct current superimposed inductance characteristics are equivalent to those in Example 19 regarding the core with the thin plate magnet being applied and the core after passing through a reflow furnace.

EXAMPLE 21

Figure 15:
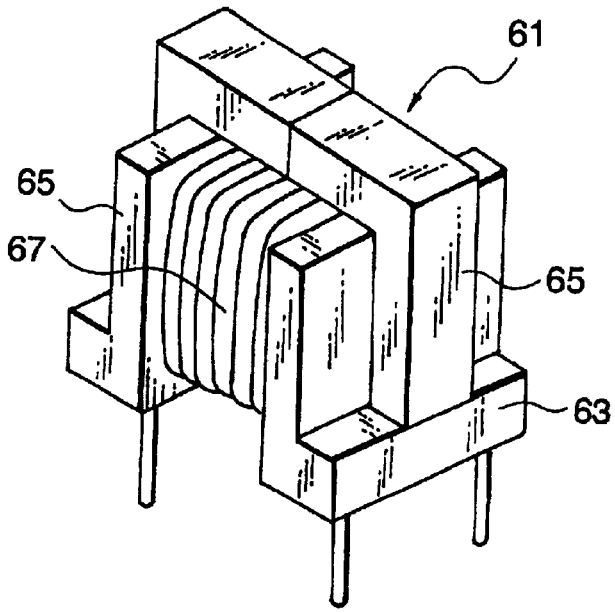
FIG. 15 is a perspective external view of an inductor component including a thin plate magnet according to Example 21 of the present invention.
Figure 16:
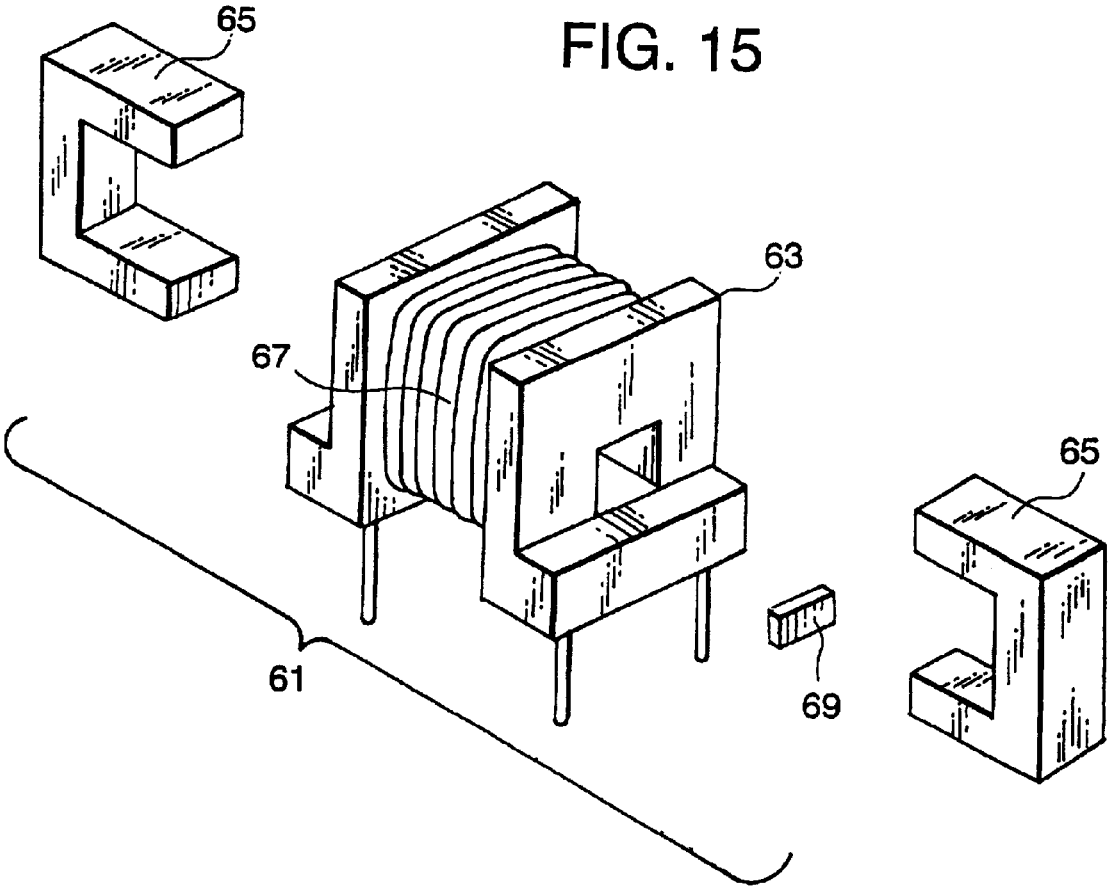
FIG. 16 is a perspective exploded view of the inductor component shown in FIG. 15.

Another inductor component including a thin plate magnet according to the present embodiment will now be described below with reference to FIGS. 15 and 16. A core 65 used in the inductor component is made of a MnZn ferrite material and constitutes a UU type magnetic core having a magnetic path length of 0.02 m and an effective cross-sectional area of $5\times10^{-6}$ $m^2$. As shown in FIG. 16, a core 67 is applied to a bobbin 63, and a thin plate magnet 69 is arranged in a core gap portion when a pair of U type cores 65 are incorporated. The thin plate magnet 69 has been processed into the same shape of the cross-section point portion) of the U type core 65, and has a thickness of 0.2 mm. This assembly functions as an inductor component having a magnetic permeability of $4\times10^{-3}$H/m.

The direction of the magnetization of the thin plate magnet 69 is specified to be reverse to the direction of the magnetic field made by the coil.

The direct current superimposed inductance characteristics were measured regarding the case where the thin plate magnet was applied and, for purposes of comparison, the case where the thin plate magnet was not applied. The results are indicated by 71 (the former) and 73 (the latter) in FIG. 17.

The results of the aforementioned direct current superimposed inductance characteristics are generally equivalent to enlargement of working magnetic flux density ($\Delta B$) of the core constituting the magnetic core, and this is supplementally described below with reference to FIGS. 18A and 18B. In FIG. 18A, reference numeral 75 indicates a working region of the core relative to a conventional inductor component, and reference numeral 77 in FIG. 18B indicates a working region of the core relative to the inductor component with the thin plate magnet according to the present invention being applied. Regarding these drawings, 71 and 77 correspond to 73 and 75, respectively, in the aforementioned results of the direct current superimposed inductance characteristics. In general, inductor components are represented by the following theoretical equation (1).

$$\Delta B=(E\cdot \text{ton})/(N\cdot Ae) \quad (1$$

wherein E denotes applied voltage of inductor component, ton denotes voltage application time, N denotes the number of turns of inductor, and Ae denotes effective cross-sectional area of core constituting magnetic core.

As is clear from this equation (1), an effect of the aforementioned enlargement of the working magnetic flux density (ΔB) is proportionate to the reciprocal of the number of turns N and the reciprocal of the effective cross-sectional area Ae, while the former brings about an effect of reducing the copper loss and miniaturization of the inductor component due to reduction of the number of turns of the inductor component, and the latter contributes to miniaturization of the core constituting the magnetic core and, therefore, contributes to miniaturization of the inductor component by a large degree in combination with the aforementioned miniaturization due to the reduction of the number of turns. Regarding the transformer, since the number of turns of the primary and secondary coils can be reduced, an enormous effect is exhibited.

Furthermore, the output power is represented by the equation (2). As is clear from the equation, the effect of enlarging working magnetic flux density (ΔB) affects an effect of increasing output power with advantage.

$$Po=\kappa\cdot(\Delta B)^2\cdot f \quad (2)$$

wherein Po denotes inductor output power, κ denotes proportionality constant, and f denotes driving frequency.

Regarding the reliability of the inductor component, the direct current superimposed inductance characteristic was measured similarly to the above description after passing through a reflow furnace (peak temperature of 270° C.). As a result, the direct current superimposed inductance characteristic after the reflow was verified to be equivalent to that before the reflow.

EXAMPLE 22

Figure 19:
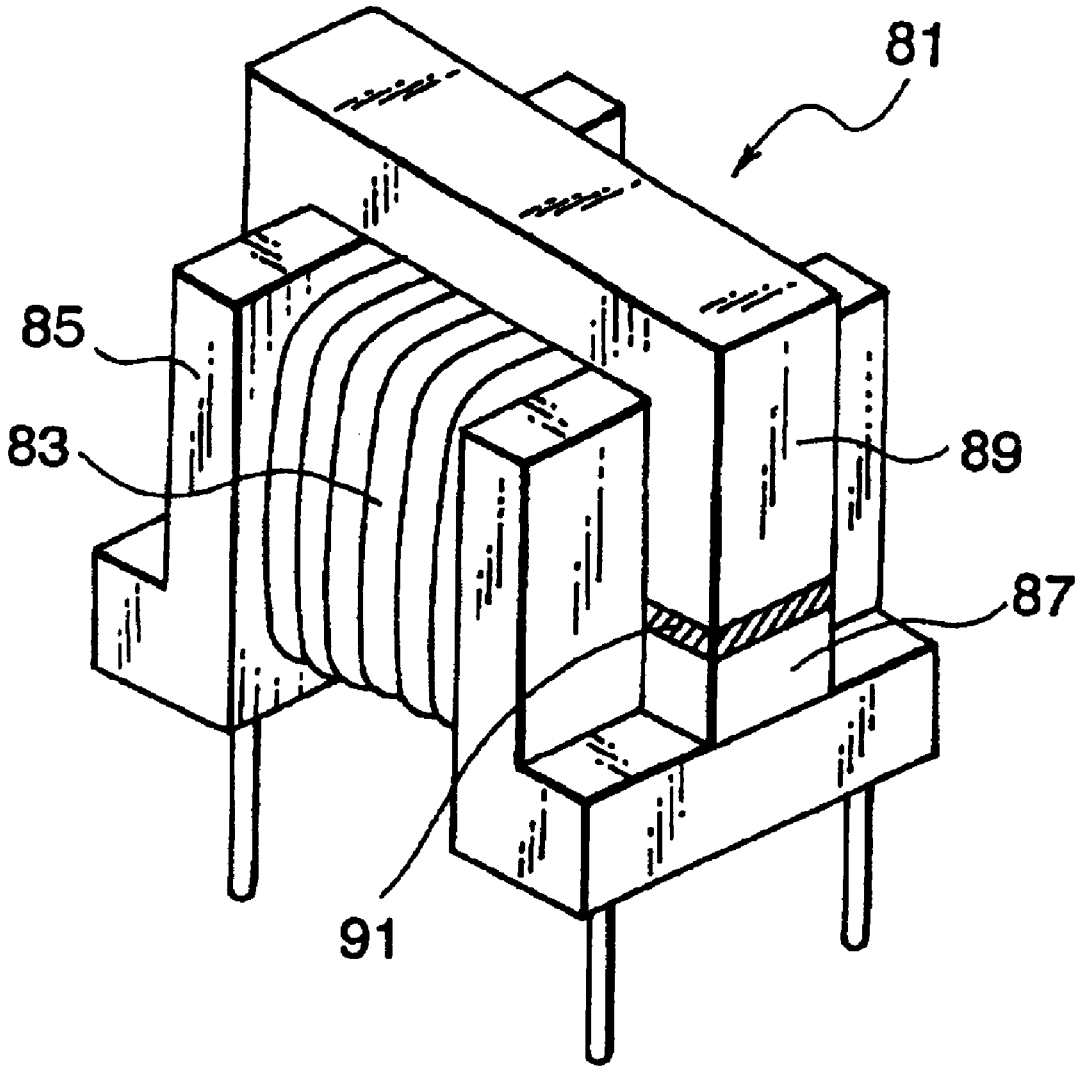
FIG. 19 is a perspective external view of an inductor component including a thin plate magnet according to Example 22 of the present invention.
Figure 20:
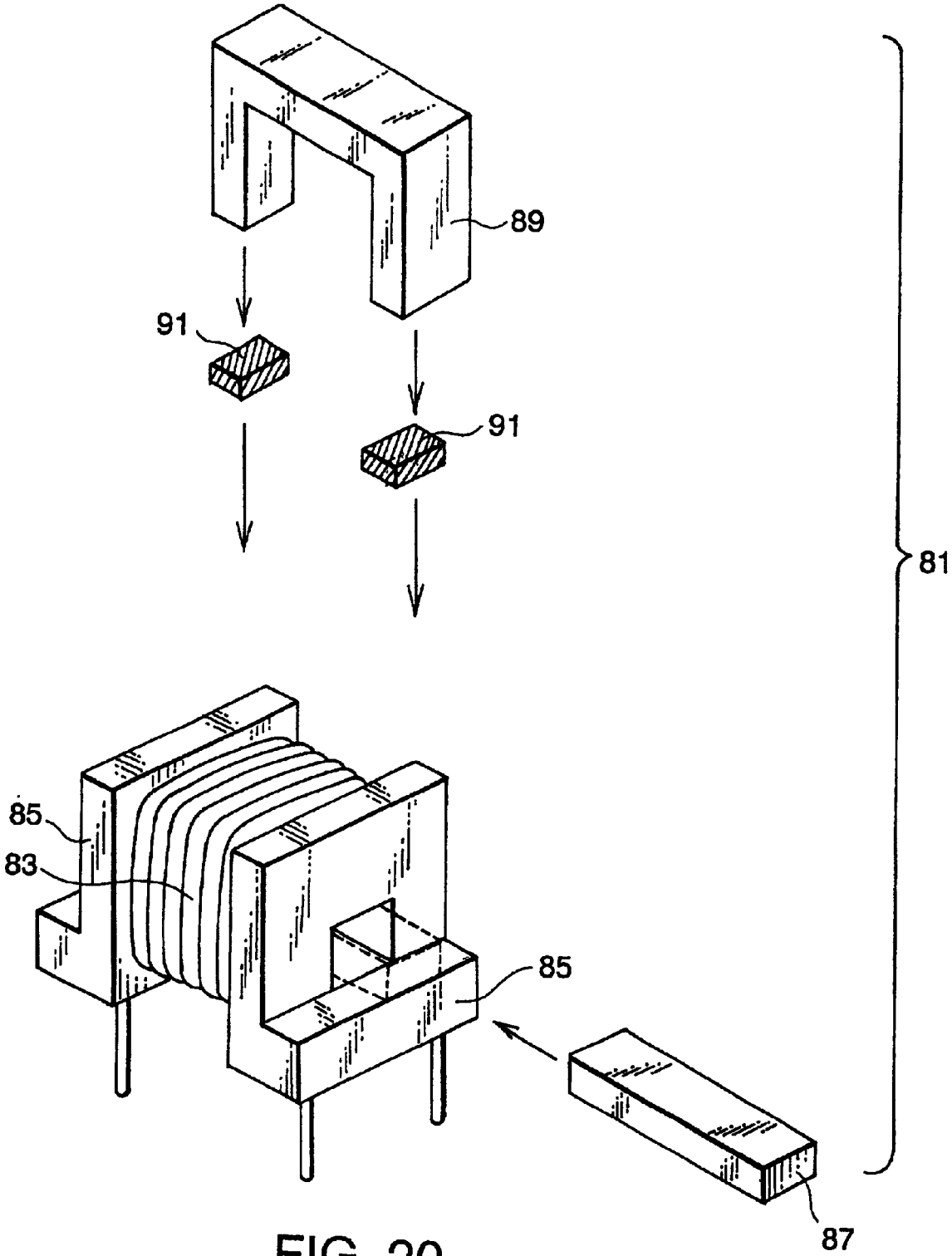
FIG. 20 is a perspective exploded view of the inductor component shown in FIG. 19.

Another inductor component including a thin plate magnet according to the present embodiment will now be described below with reference to FIGS. 19 and 20. A core used in the inductor component is made of a MnZn ferrite material and constitutes a magnetic core having a magnetic path length of 0.02 m and an effective cross-sectional area of $5\times10^{-6}$ $m^2$ in a manner similar to that in Example 21, or constitutes a UI type magnetic core and, therefore, functions as the inductor component. As shown in FIG. 20, a coil 83 is applied to a bobbin 85, and an I type core 87 is incorporated in the bobbin 85. Subsequently, thin plate magnets 91 are arranged on both flange portions of the coiled bobbin (on the portions of the I type core 87 extending off the bobbin) on a one-by-one basis (total two magnets for both flanges), and a U type core 89 is incorporated and, therefore, the inductor component is completed. The thin plate magnets 91 have been processed into the same shape of the cross-section (joint portion) of the U type core 89, and have a thickness of 0.1 mm.

The direct current superimposed inductance characteristics are equivalent to those in Example 21 regarding the core with the thin plate magnet being applied and the core after passing through a reflow furnace.

EXAMPLE 23

Figure 21:
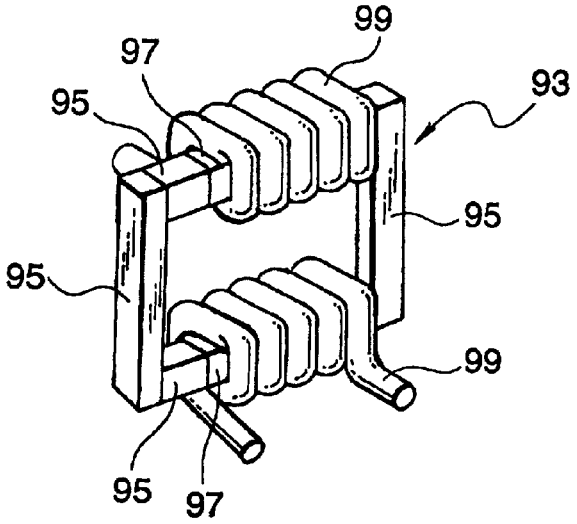
FIG. 21 is a perspective external view of an inductor component including a thin plate magnet according to Example 23 of the present invention.
Figure 22:
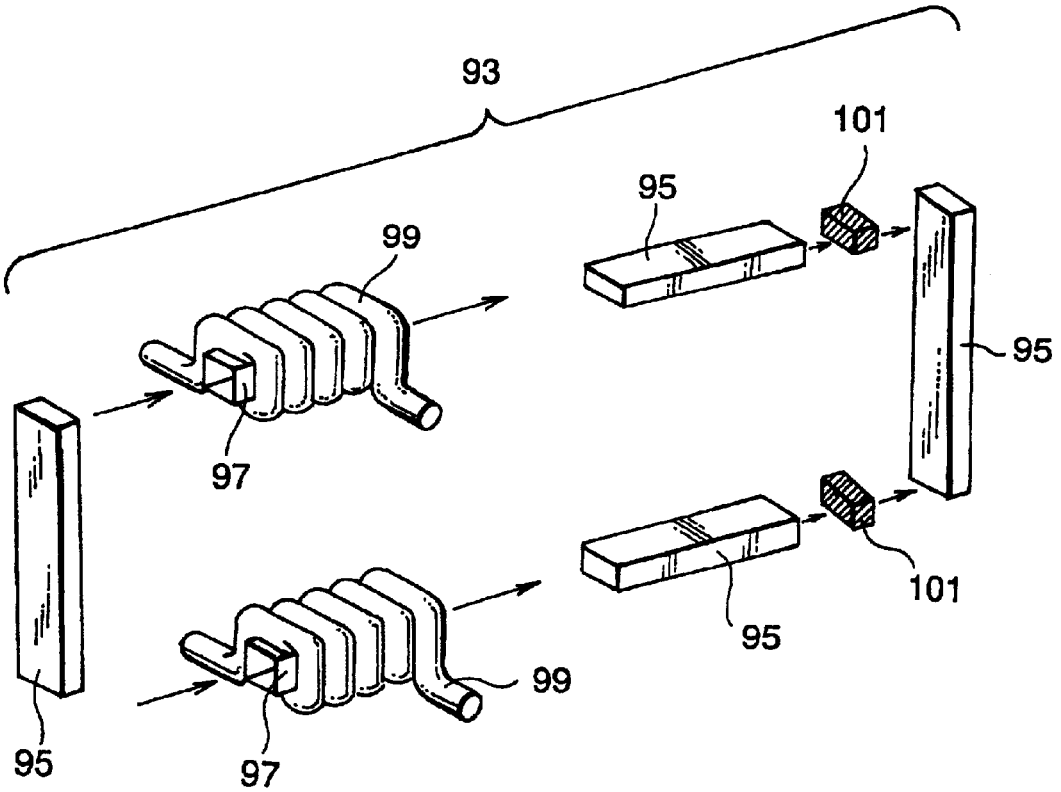
FIG. 22 is a perspective exploded view of the inductor component shown in FIG. 21.

Another inductor component including a thin plate magnet according to the present embodiment will now be described below with reference to FIGS. 21 and 22. Four I type cores 95 used in the inductor component are made of silicon steel and constitutes a square type magnetic core having a magnetic path length of 0.2 m and an effective cross-sectional area of $1\times10^{-4}$ $m^2$. As shown in FIG. 21, the I type cores 95 are inserted into two coils 99 having insulating paper 97 on a one-by-one basis, and another two I type cores 95 are incorporated in order to form a square type magnetic path. Magnetic cores 101 according to the present invention are arranged at the joint portions thereof and, therefore, the square type magnetic path having a permeability of $2\times10^{-2}$ H/m is formed and functions as the inductor component.

The direction of the magnetization of the thin plate magnet 101 is specified to be reverse to the direction of the magnetic field made by the coil.

Figure 23:
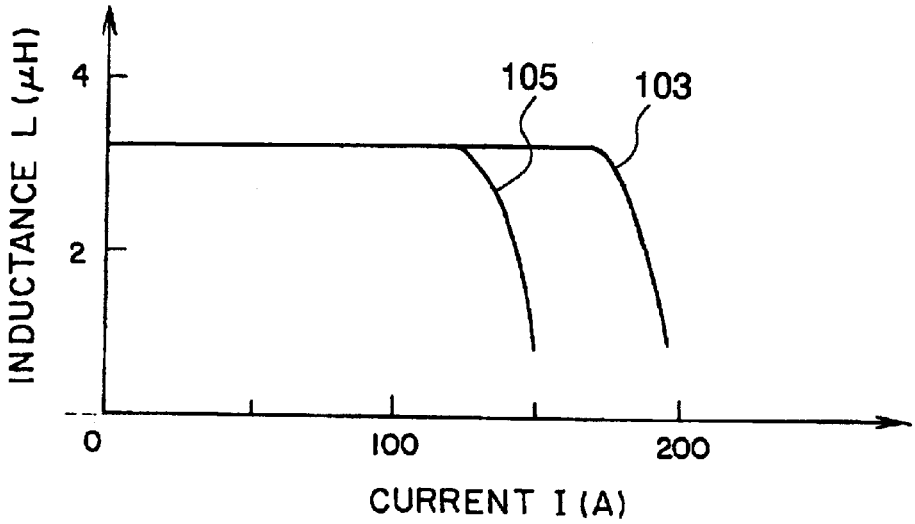
FIG. 23 is a graph showing measurement data of the direct current superimposed inductance characteristic in the case where a thin plate magnet is applied and in the case where no thin plate magnet is applied for purposes of comparison.

The direct current superimposed inductance characteristics were measured regarding the case where the thin plate magnet was applied and, for purposes of comparison, where the thin plate magnet was not applied. The results are indicated by 103 (the former) and 105 (the latter) in FIG. 23.

Figure 24A:
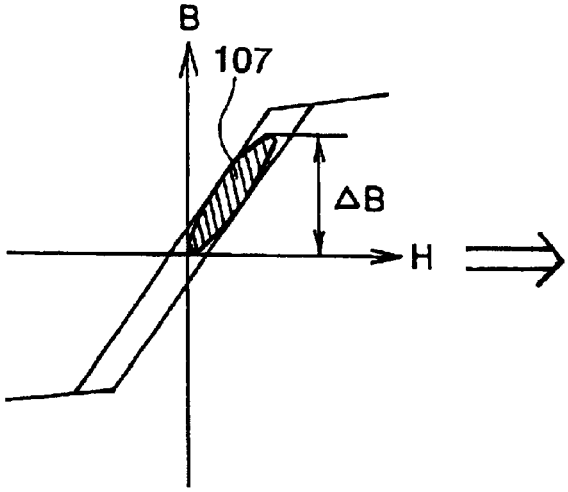
FIG. 24A PRIOR ART
FIG. 24A is a drawing showing a working region of a core relative to a conventional inductor component.
Figure 24B:
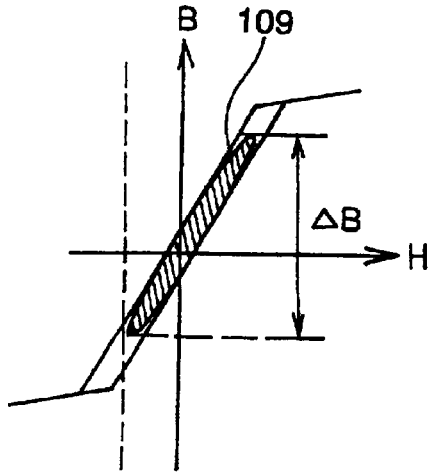
FIG. 24B is a drawing showing a working region of a core relative to an inductor component including a thin plate magnet according to Example 23 of the present invention.

The results of the aforementioned direct current superimposed inductance characteristics are generally equivalent to enlargement of working magnetic flux density (ΔB) of the core constituting the magnetic core, and this is supplementally described below with reference to FIGS. 24A and 24B. In FIG. 24A, reference numeral 107 indicates a working region of the core relative to a conventional inductor component, and reference numeral 109 in FIG. 24B indicates a working region of the core relative to the inductor component with the thin plate magnet according to the present invention being applied. Regarding these drawings, 103 and 105 correspond to 109 and 107, respectively, in the aforementioned results of the direct current superimposed inductance characteristics. In general, inductor components are represented by the following theoretical equation (1).

$$\Delta B=(E\cdot \text{ton})/(N\cdot Ae) \quad (1)$$

wherein E denotes applied voltage of inductor component, ton denotes voltage application time, N denotes the number of turns of inductor, and Ae denotes effective cross-sectional area of core constituting magnetic core.

As is clear from this equation (1), an effect of the aforementioned enlargement of the working magnetic flux density (ΔB) is proportionate to the reciprocal of the number of turns N and the reciprocal of the effective cross-sectional area Ae, while the former brings about an effect of reducing the copper loss and miniaturization of the inductor component due to reduction of the number of turns of the inductor component, and the latter contributes to miniaturization of the core constituting the magnetic core and, therefore, contributes to miniaturization of the inductor component by a large degree in combination with the aforementioned miniaturization due to the reduction of the number of turns. Regarding the transformer, since the number of turns of the primary and secondary coils can be reduced, an enormous effect is exhibited.

Furthermore, the output power is represented by the equation (2). As is clear from the equation, the effect of enlarging working magnetic flux density (ΔB) affects an effect of increasing output power with advantage.

$$Po=\kappa\cdot(\Delta B)^2\cdot f \quad (2)$$

wherein Po denotes inductor output power, κ denotes proportionality constant, and f denotes driving frequency.

Regarding the reliability of the inductor component, the direct current superimposed inductance characteristic was measured similarly to the above description after passing through a reflow furnace (peak temperature of 270° C.). As a result, the direct current superimposed inductance characteristic after the reflow was verified to be equivalent to that before the reflow.

EXAMPLE 24

Figure 25:
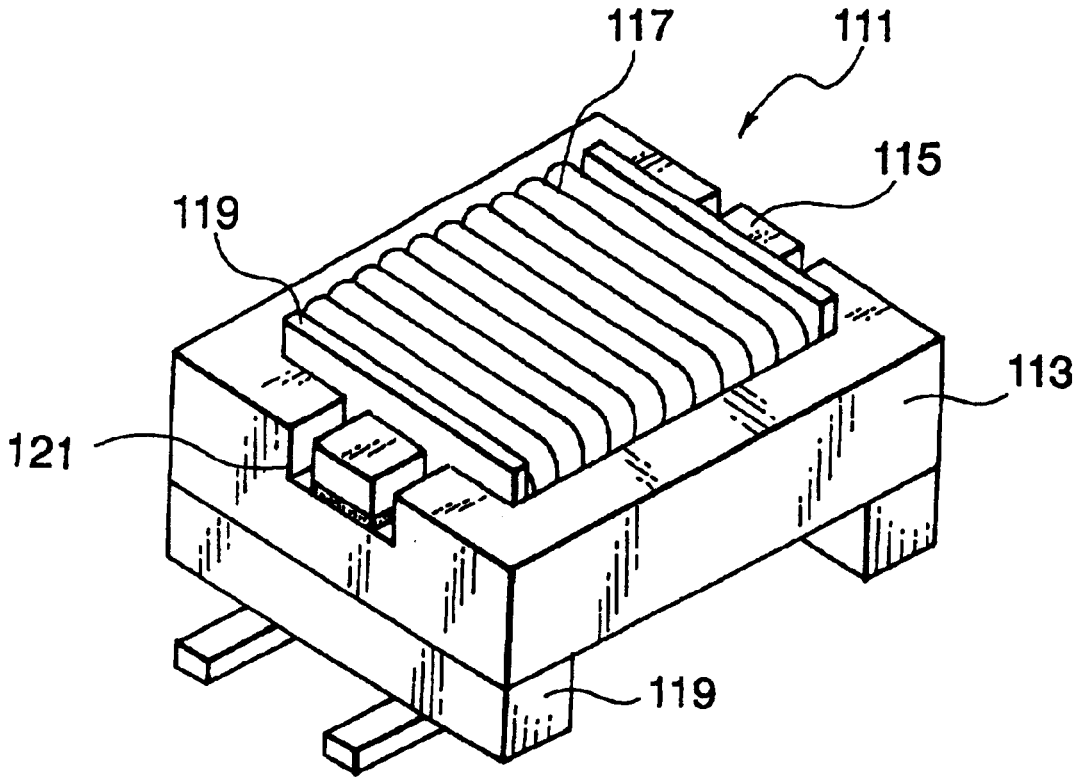
FIG. 25 is a perspective external view of an inductor component including a thin plate magnet according to Example 24 of the present invention.
Figure 26:
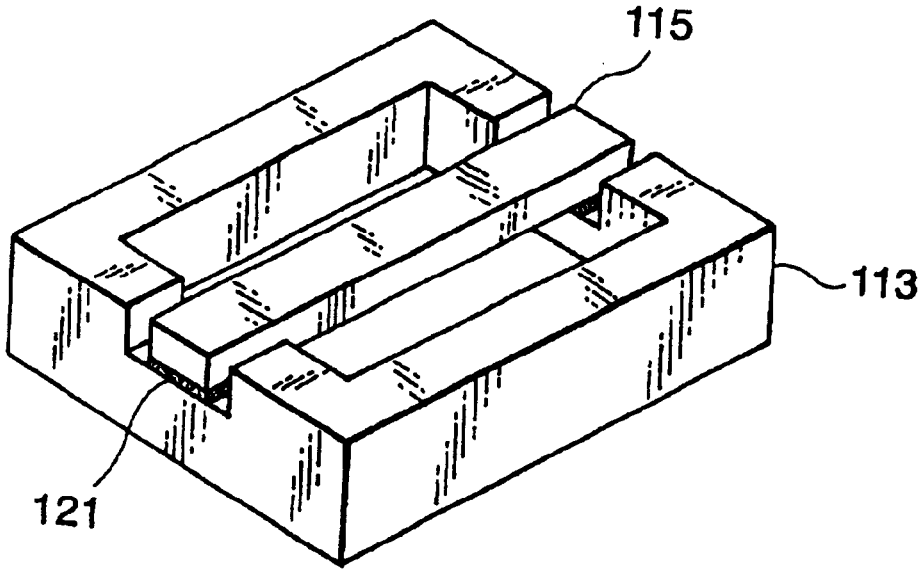
FIG. 26 is a perspective configuration view of a core and a thin plate magnet constituting a magnetic path of the inductor component shown in FIG. 25.

Another inductor component including a thin plate magnet according to the present embodiment will now be described below with reference to FIGS. 25 and 26. The inductor component is composed of a square type core 113 having rectangular concave portions, an I type core 115, a bobbin 119 with a coil 117 being applied, and thin plate magnets 121. As shown in FIG. 26, the thin plate magnets 121 are arranged in the rectangular concave portions of the square type core 113, that is, at the joint portions of the square type core 113 and the I type core 115.

Herein, the aforementioned square type core 113 and I type core 115 are made of MnZn ferrite material, and constituting the magnetic core having a shape of the two same rectangles arranged side-by-side and having a magnetic path length of 6.0 cm and an effective cross-sectional area of 0.1 $cm^2$.

The thin plate magnet 121 has a thickness of 0.25 mm and a cross-sectional area of 0.1 $cm^2$, and direction of the magnetization of the thin plate magnet 121 is specified to be reverse to the direction of the magnetic field made by the coil.

Figure 27:
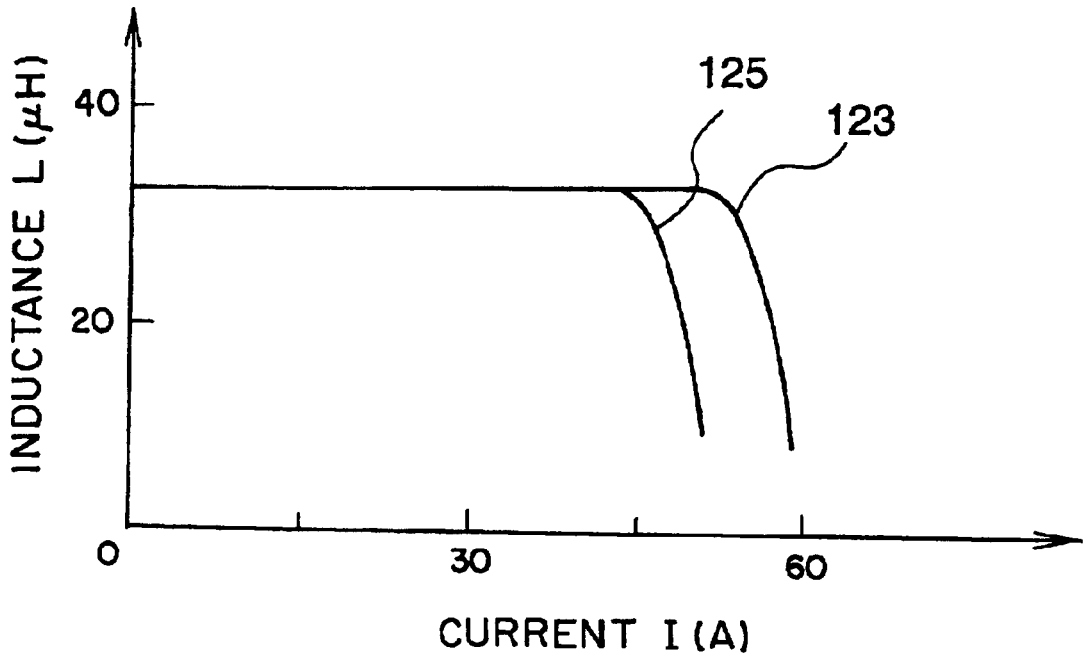
FIG. 27 is a graph showing measurement data of the direct current superimposed inductance characteristic in the case where a thin plate magnet according to the present invention is applied and in the case where no thin plate magnet is applied for purposes of comparison.

The coil 117 has the number of turns of 18 turns, and the direct current superimposed inductance characteristics were measured regarding the inductor component according to the present embodiment and, for purposes of comparison, regarding the case where the thin plate magnet was not applied. The results are indicated by 123 (the former) and 125 (the latter) in FIG. 27.

The direct current superimposed inductance characteristic was measured similarly to the above description after passing through a reflow furnace (peak temperature of 270° C.). As a result, the direct current superimposed inductance characteristic after the reflow was verified to be equivalent to that before the reflow.

EXAMPLE 25

Figure 28:
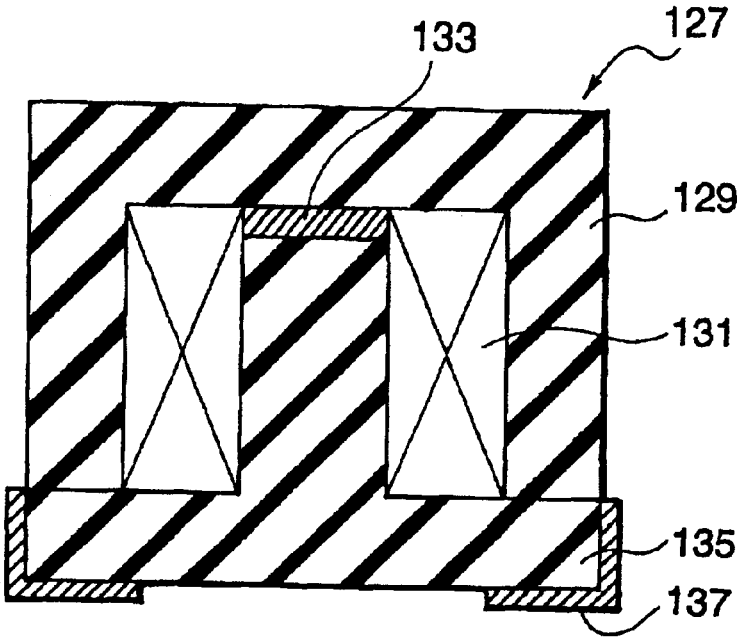
FIG. 28 is a sectional view of an inductor component including a thin plate magnet according to Example 25 of the present invention.
Figure 29:
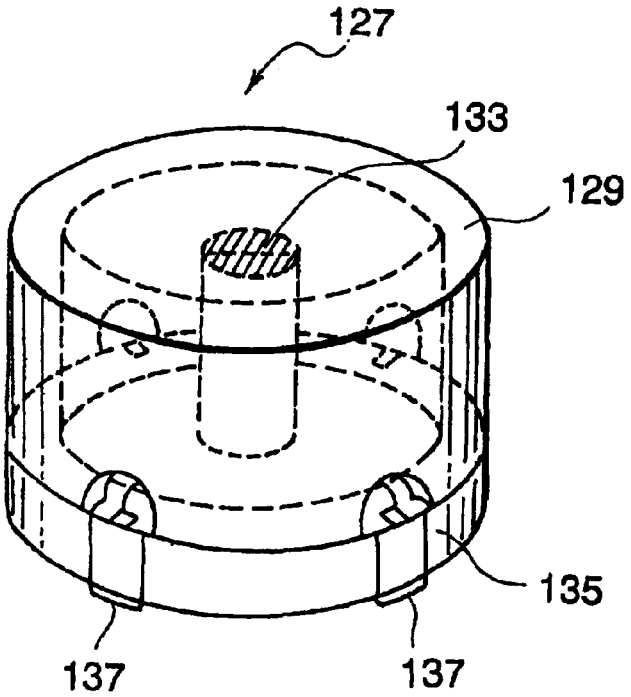
FIG. 29 is a perspective configuration view of a core and a thin plate magnet constituting a magnetic path of the inductor component shown in FIG. 28.

Another inductor component including a thin plate magnet according to the present embodiment will now be described below with reference to FIGS. 28 and 29. Regarding the configuration of the inductor component, a coil 131 is applied to a convex type core 135, a thin plate magnets 133 is arranged on the top surface of the convex portion of the convex type core 135, and these are covered with a cylindrical cap core 129. The thin plate magnet 133 has the same shape (0.07 mm) with the top surface of the convex portion, and has a thickness of 120 $\mu$m.

Herein, the aforementioned convex type core 135 and cylindrical cap core 129 are made of NiZn ferrite material, and constituting the magnetic core having a magnetic path length of 1.85 cm and an effective cross-sectional area of 0.07 $cm^2$.

The direction of the magnetization of the thin plate magnet 133 is specified to be reverse to the direction of the magnetic field made by the coil.

Figure 30:
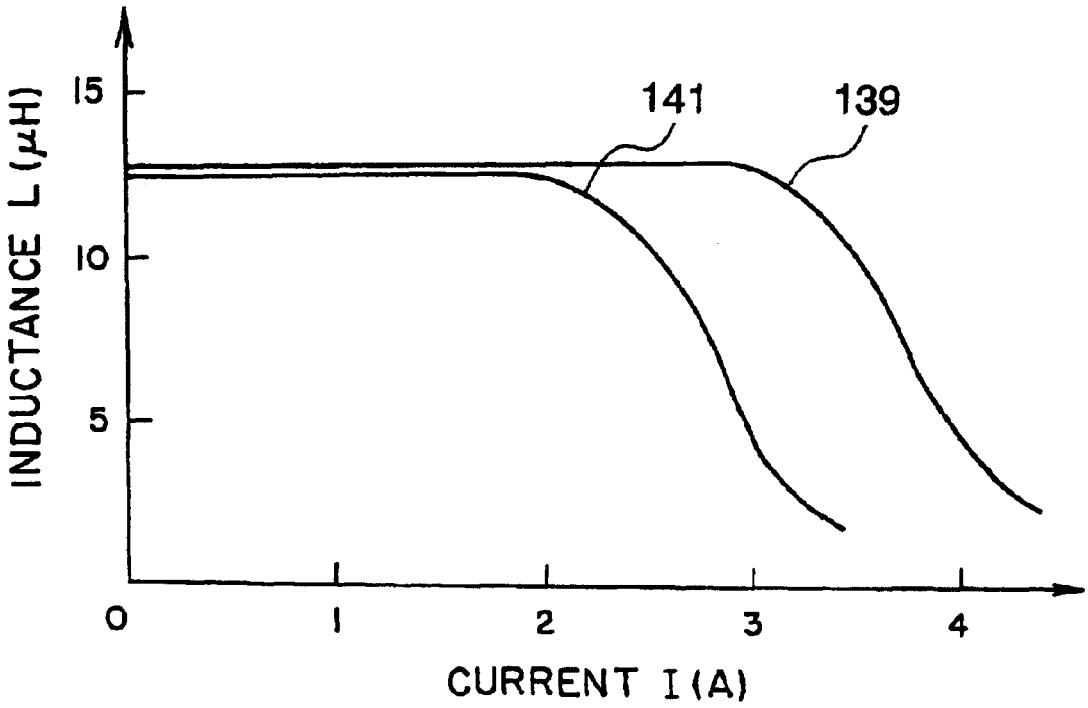
FIG. 30 is a graph showing measurement data of the direct current superimposed inductance characteristic of the inductor component including a thin plate magnet according to Example 25 of the present invention and in the case where no thin plate magnet is applied for purposes of comparison.

The coil 131 has the number of turns of 15 turns, and the direct current superimposed inductance characteristics were measured regarding the inductor component according to the present embodiment and, for purposes of comparison, regarding the case where the thin plate magnet was not applied. The results are indicated by 139 (the former) and 141 (the latter) in FIG. 30.

The direct current superimposed inductance characteristic was measured similarly to the above description after passing through a reflow furnace (peak temperature of 270° C.). As a result, the direct current superimposed inductance characteristic after the reflow was verified to be equivalent to that before the reflow.

What is claimed is:

1. A permanent magnet having a resistivity of 0.1 Ω·cm or more and consisting of a bonded magnet which comprises a magnet powder dispersed in a resin, the magnet powder comprising a magnetic powder coated with inorganic glass, and having an intrinsic coercive force of 5 KOe or more, a Curie point Tc of 300° C. or more, and a particle diameter of the powder of 150 $\mu$m or less.

2. The permanent magnet according to claim 1, comprising the inorganic glass at a content of 10% by weight or less.

3. The permanent magnet according to claim 2, wherein the magnet powder has an average particle diameter of 2.0 to 50 $\mu$m.

4. The permanent magnet according to claim 3, wherein the magnet powder has an average particle diameter of 2.5 to 25 $\mu$m and a maximum particle diameter of 50 $\mu$m or less.

5. The permanent magnet according to claim 2, wherein the inorganic glass has a softening point of 220° C. to 500° C.

6. The permanent magnet according to claim 2, wherein a content of the resin is 20% by volume or more.

7. The permanent magnet according to claim 2, wherein the magnet powder is a rare-earth magnet powder.

8. The permanent magnet according to claim 2, wherein a molding compressibility is 20% or more.

9. The permanent magnet according to claim 2, wherein the resistivity is 1 Ω·cm or more.

10. The permanent magnet according to claim 2, wherein the magnet powder has an average particle diameter of 2.5 to 50 $\mu$m.

11. The permanent magnet according to claim 2, wherein the magnet powder has the intrinsic coercive force of 10 KOe or more, and the Curie point Tc of 500° C. or more.

12. The permanent magnet according to claim 11, wherein the inorganic glass has a softening point of 400° C. to 550° C.

13. The permanent magnet according to claim 11, wherein the content of the resin is 30% by volume or more.

14. The permanent magnet according to claim 11, wherein the magnet powder is a rare-earth magnet powder.

15. The permanent magnet according to claim 11, wherein the molding compressibility is 20% or more.

16. The permanent magnet according to claim 11, wherein the resistivity is 1 Ω·cm or more.

17. The permanent magnet according to claim 2, wherein the total thickness is 10,000 $\mu$m or less.

18. The permanent magnet according to claim 17, wherein the total thickness is 500 $\mu$m or less.

19. The permanent magnet according to claim 2, wherein a magnetizing magnetic field is 2.5 T.

20. The permanent magnet according to claim 2, wherein a center line average roughness Ra is 10 $\mu$m or less.

21. The permanent magnet according to claim 2, the permanent magnet being produced by die molding.

22. The permanent magnet according to claim 2, the permanent magnet being produced by hot press.

23. The permanent magnet according to claim 2, the permanent magnet being produced from a mixed coating of a resin and a magnet powder by a film making method, such as a doctor blade method and printing method.

24. The permanent magnet according to claim 2, having a surface glossiness of 25% or more.

25. The permanent magnet according to claim 2, wherein the resin is at least one selected from the group consisting of polypropylene resins, 6-nylon resins, 12-nylon resins, polyimide resins, polyethylene resins, and epoxy resins.

26. The permanent magnet according to claim 2, wherein the resin is at least one selected from the group consisting of polyimide resins, poly(amide-imide) resins, epoxy resins, poly(phenylene sulfide) resins, silicone resins, polyester resins, aromatic polyamide resins, and liquid crystal polymers.

27. The permanent magnet according to claim 7, wherein the magnet powder is a rare-earth magnet powder selected from the group consisting of SmCo, NdFeB, and SmFeN.

28. The permanent magnet according to claim 27, wherein the magnet powder is a Sm—Co magnet.

29. The permanent magnet according to claim 28, wherein the SmCo rare-earth magnet powder is an alloy powder represented by $Sm(Co_{bal}Fe_{0.15\ to\ 0.25}Cu_{0.05\ to\ 0.06}Zr_{0.02\ to\ 0.03})_{7.0\ to\ 8.5}$.

30. A magnetic core comprising a magnet for magnetic bias, wherein the magnet for magnetic bias being the permanent magnet according to claim 1, and being arranged in the neighborhood of a magnetic gap in order to supply magnetic bias from both sides of the gap to the magnetic core, the magnetic core comprising at least one magnetic gap in a magnetic path.

31. A magnetic core comprising a magnet for magnetic bias, the magnet for magnetic bias being the permanent magnet according to claim 17 and being arranged in the neighborhood of a magnetic gap in order to supply magnetic bias from both sides of the gap to the magnetic core, the magnetic core comprising at least one magnetic gap in a magnetic path, wherein the magnetic gap has a gap length of about 50 to 10,000 $\mu$m.

32. The magnetic core comprising a magnet for magnetic bias according to claim 31, wherein the magnetic gap has a gap length exceeding 500 $\mu$m, the magnet for magnetic bias having a thickness corresponding to the magnetic gap length.

33. The magnetic core comprising a magnet for magnetic bias according to claim 31, wherein the magnetic gap has a gap length of 500 $\mu$m or less, the magnet for magnetic bias having a thickness corresponding to the magnetic gap length.

34. An inductor component comprising a magnet for magnetic bias according to claim 31 and at least one coil having at least one turn, wherein said at least one coil is applied to the magnetic core comprising a magnet for magnetic bias according to claim 31.

* * * * *